United States Patent [19]

Welling et al.

[11] 4,232,903

[45] Nov. 11, 1980

[54] OCEAN MINING SYSTEM AND PROCESS

[75] Inventors: Conrad G. Welling, Atherton; Gordon H. Davenport; Guenter Reichert, both of San Jose; Charles M. Snyder, Saratoga; Milton C. Harrold, Ben Lomond; Salvatore H. Donze, Santa Clara; Frank R. Larsen, Saratoga, all of Calif.

[73] Assignee: Lockheed Missiles & Space Co., Inc., Sunnyvale, Calif.

[21] Appl. No.: 973,854

[22] Filed: Dec. 28, 1978

[51] Int. Cl.[3] ..... E02F 3/92; E02F 3/94; E02F 7/00

[52] U.S. Cl. ..... 299/8; 37/54; 37/DIG. 8

[58] Field of Search ..... 299/7-9; 37/DIG. 8

[56] References Cited

U.S. PATENT DOCUMENTS

| | | | |
|---|---|---|---|
| 3,314,174 | 4/1967 | Haggard | 37/54 |
| 3,522,670 | 8/1970 | Flipse et al. | 299/8 |
| 3,672,725 | 6/1972 | Johnson | 299/8 |
| 3,697,134 | 10/1972 | Murray | 299/8 |
| 3,811,730 | 5/1974 | Dane | 299/8 |
| 3,971,593 | 7/1976 | Porte et al. | 37/DIG. 8 |
| 4,035,022 | 7/1977 | Hahlbrock et al. | 299/8 |
| 4,040,667 | 8/1977 | Tax et al. | 299/8 |
| 4,070,061 | 1/1978 | Obolensky | 299/8 |

FOREIGN PATENT DOCUMENTS

| | | | |
|---|---|---|---|
| 2801708 | 7/1978 | Fed. Rep. of Germany | 299/8 |

*Primary Examiner*—Ernest R. Purser
*Attorney, Agent, or Firm*—Donald C. Feix

[57] ABSTRACT

An ocean mining system for mining manganese nodules comprises a surface subsystem and an ocean bottom subsystem.

The ocean bottom subsystem includes a mobile, maneuverable, self-propelled, miner vehicle which picks up, handles, washes and crushes nodules while retaining nodule fines.

The underwater subsystem also includes a buffer which functions to provide temporary storage for nodule material picked up and crushed by the miner vehicle. The buffer further serves to isolate the miner vehicle from the dynamics of a pipe string extending down from a surface ship. All equipment not needed for operation of the miner vehicle is located on the buffer to distribute the weight between the buffer and the miner vehicle in a way that provides maximum mobility of the miner vehicle.

The underwater subsystem also includes a flexible linkage extending between the miner vehicle and the buffer. A flotation block holds the flexible linkage up and out of the way of the miner vehicle during operation of the vehicle. This flexible linkage permits operation of the miner vehicle within a boundary envelope beneath the buffer as determined by the flexible linkage.

The surface subsystem includes a ship which provides all operational control and maintenance support for the bottom subsystem.

The ocean mining system includes sensors and controls. The sensors sense the location of the miner vehicle within the permitted area of operation, display the topography of the ocean floor adjacent the miner vehicle and also display all aspects of the movement of the miner vehicle and pick-up and handling of the nodules. The controls provide active control of every component of the ocean bottom subsystem from the surface ship.

99 Claims, 39 Drawing Figures

51
63
53
65
67
59
68
69
55
61
57
113
127
79
105
231
83
81
75
197
89
91
101
133
229
111
109
114
142
73
99
107
93
201
183
161
159
157
173
171
132

117
105
103
99
93
114
111
142
109
95
107
232
71
229
231
127
79
133
115
83
81
193
157
159
113
195
87
132
7
6
73
183
181
75
119
123
121
57

57
87
93
105
113
114
115
117
119
121
125
127
129
131
71

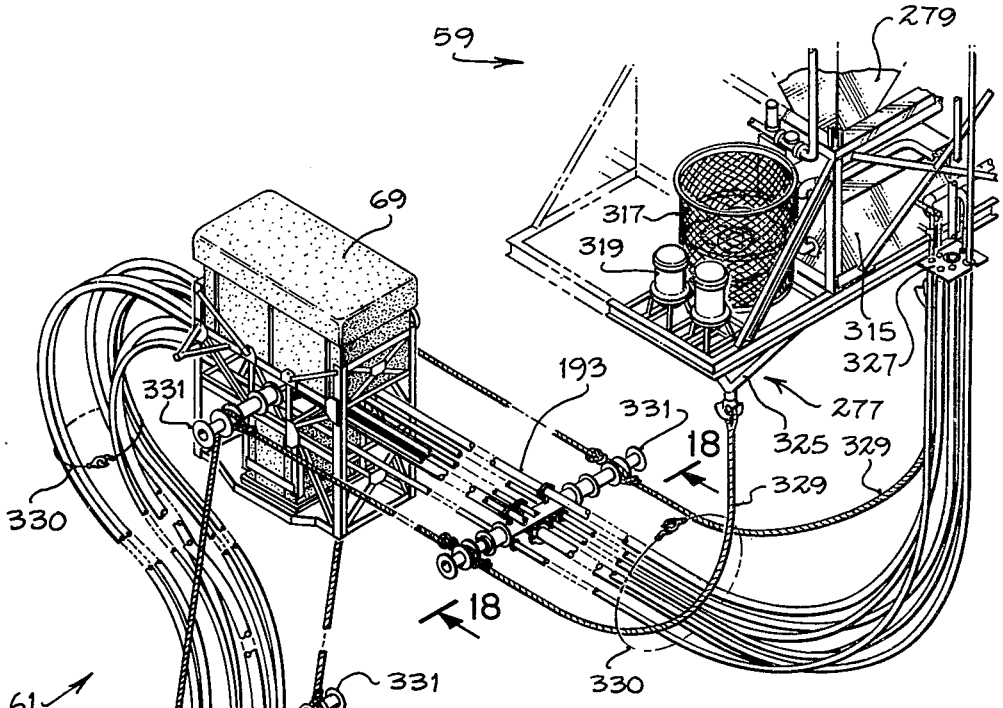
FIG_17
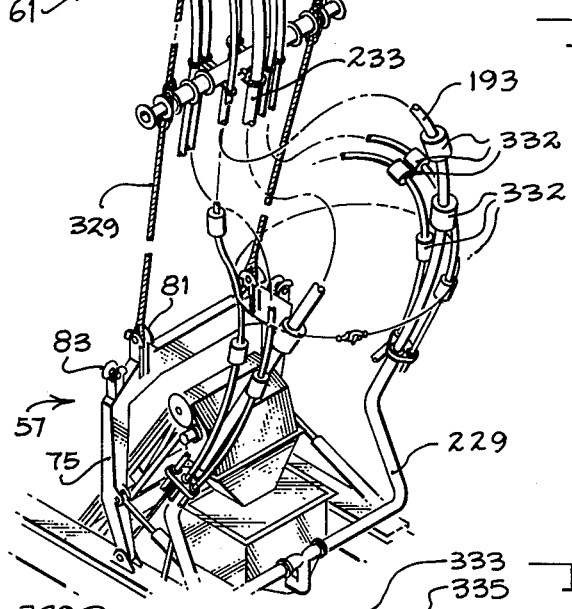
FIG_18
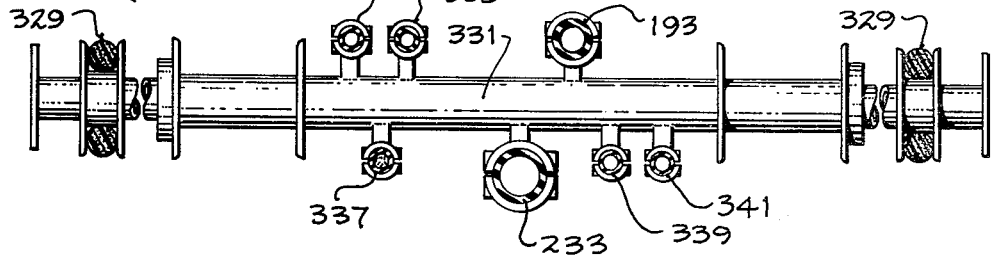

FIG_23
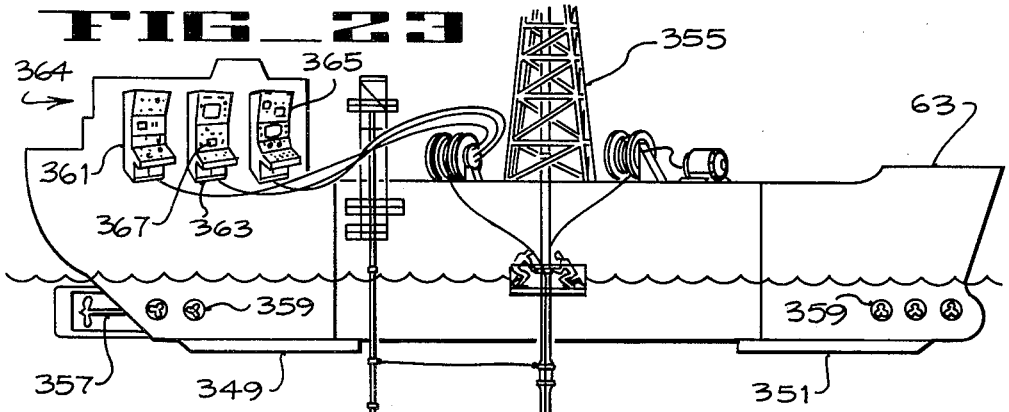
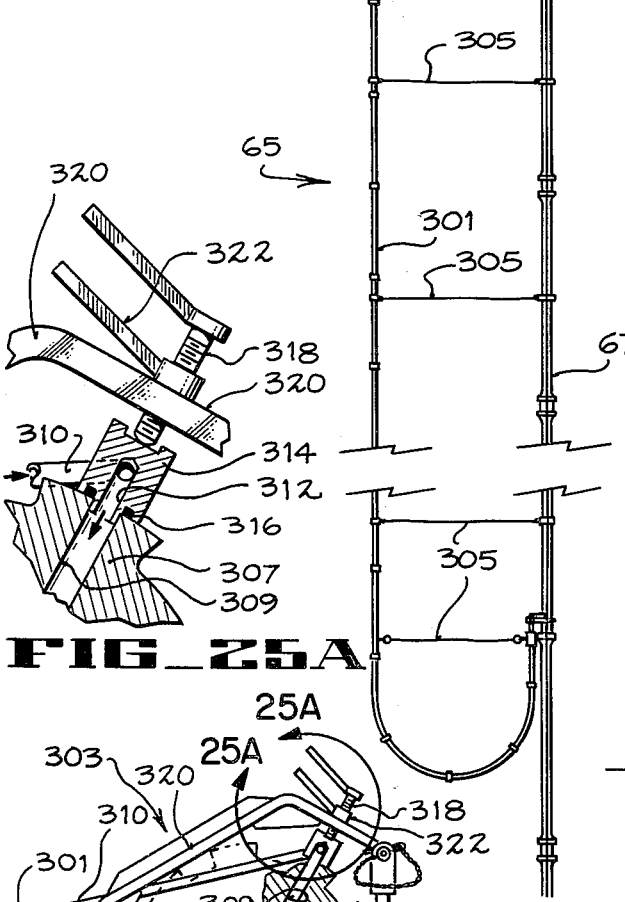
FIG_25A
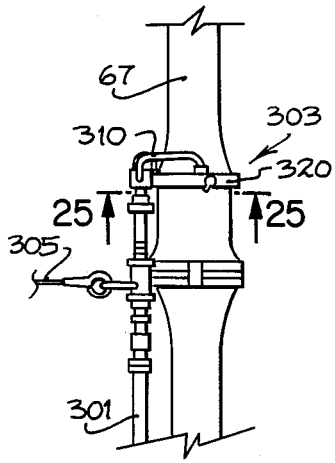
FIG_24
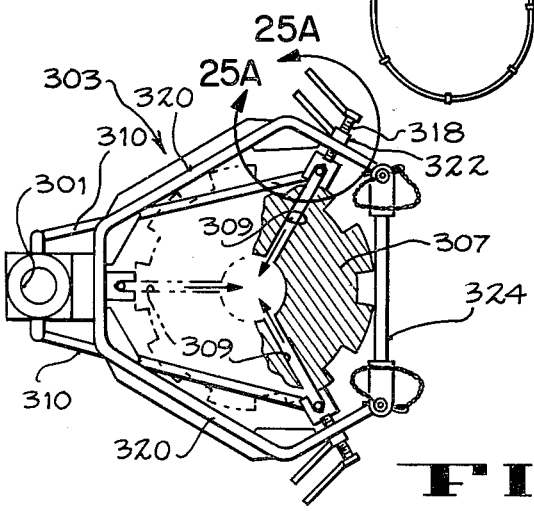
FIG_25

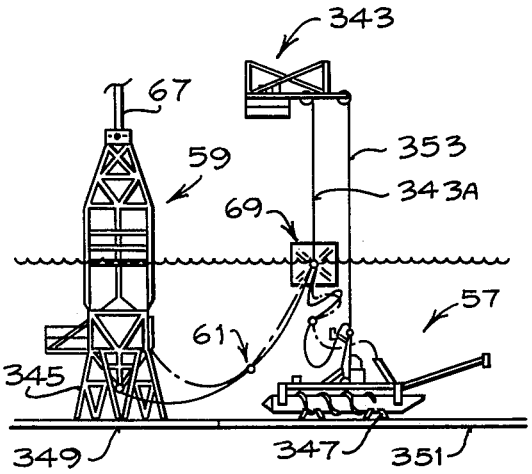
FIG_27
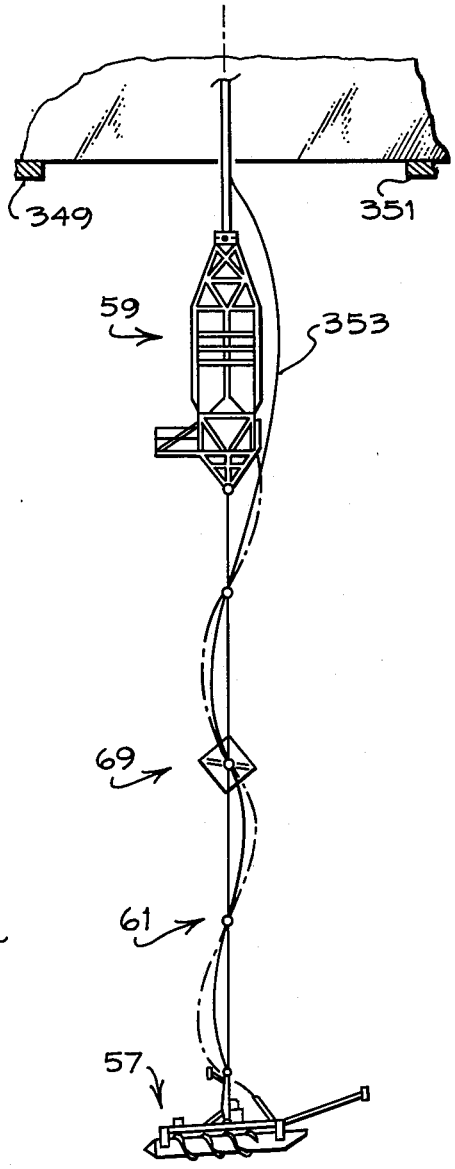
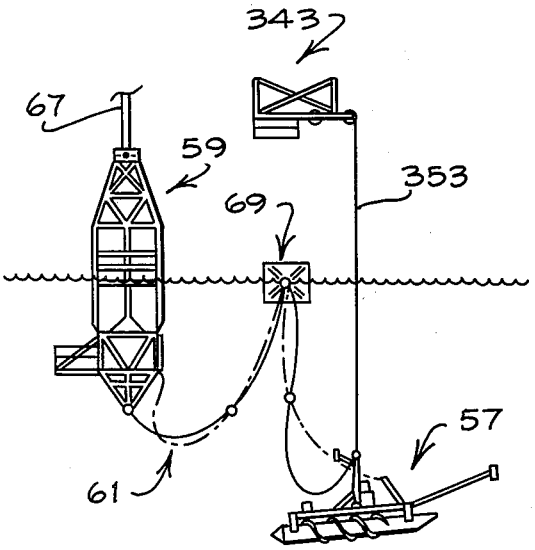
FIG_28 FIG_29

51
53
55
57
59
61
63
65
67
79
109
113
119
134
136
140
142
143
144
183
187
191
193
233
250
252
254
256
258
279
281
283
287
289
303
311
313
315
317
326
328
334
336
338
346
348
350
352
354
358
360
361
362
363
364
365
366
368
370
372
374
376
378
401
403
405
407
409
425
427

51
63
53
55
57
59
61
65
67
361
363
365
364
374
376
378
370
372
256
354
360
364
366
368
427
358
362
303
297
279
299
334
336
338
295
258
252
346
348
401
405
283
281
326
254
403
250
287
313
311
317
328
315
191
233
289
193
79
109
409
183
187
407
144
140
134
136
350
352
143
263
142
113
119

OCEAN MINING SYSTEM AND PROCESS

BACKGROUND OF THE INVENTION

This invention relates to methods and apparatus for ocean mining of manganese nodules.

Manganese nodules are abundant and cover large portions of the ocean floor. An average nodule is about two inches in diameter, has an irregular surface, and contains concentrations of manganese (approximately 25%), copper 1.2%), nickel (1.5%), and cobalt (0.2%). The nodules can be found in water as shallow as one hundred feet and to depths of more than twenty thousand feet. Rich and concentrated nodule fields are found in the Pacific Ocean southeast of Hawaii in 14,000 to 18,000 feet of water. The nodules rest at the surface of the ocean floor, even though they may have formed over a time period measured in hundreds or perhaps thousands of years.

The nodules were discovered by researchers aboard the H.M.S. Challenger during an 1873–1876 oceanographic expedition, about one hundred years ago. There were early proposals on underwater mining apparatus and techniques that are also about one hundred years old, but the early proposals were generally directed toward dredging methods. Picking up small nodules on the ocean floor in deep ocean (where the most concentrated fields of nodules occur) by dredging, and then raising the nodules more than ten thousand feet to the surface, is difficult to accomplish efficiently with dredging techniques.

Some more recent proposals for deep ocean mining of the nodules have included remotely controlled self-propelled vehicles pre-programmed to operate on the ocean floor. However, to be effective and efficient, a vehicle operating on the ocean floor must have many capabilities. For example, the vehicle must be able to sense and to avoid obstacles, such as large rocks and ditches or crevasses. It should also be able to vary the speed and direction of movement to best suit the local conditions. And the operation of the nodule pick-up and handling mechanism should be variable and controllable as required, etc.

SUMMARY OF THE INVENTION

It is a primary object of the present invention to actively control all aspects of ocean nodule pick-up and handling from a surface ship.

The ocean mining system of the present invention comprises a miner vehicle that operates on the ocean floor.

The miner vehicle serves as a transport vehicle for nodule pick-up and handling mechanisms that pick up the nodules from the ocean floor and then wash and crush the nodules to a nodule slurry.

Every component of the miner vehicle and nodule pick-up and handling mechanism is constructed and operated to provide high efficiency throughout the entire nodule mining operation.

The vehicle is constrcted with propulsion apparatus for navigating a wide variety of terrain to accommodate the varied topography of the ocean floor.

The vehicle has a high degree of maneuverability to permit efficient working of a nodule field.

The nodule pick-up and handling mechanism is constructed to accomplish maximum pick-up of nodules within a selected size range and then to minimize any loss of particles from the nodules during subsequent handling of the nodules.

The ocean mining system of the present invention incorporates sensors and controls for continuously observing and for actively controlling all aspects of the mining operation.

In a specific embodiment of the present invention, the sensors include: side scanning sonar (for viewing the topography in the immediate vicinity of the miner vehicle); position locating sonar (for detecting and indicating the exact location of the miner vehicle within a controlled envelope of operation); and TV cameras for observing the terrain around the miner vehicle, the overall operation of the miner vehicle on the ocean floor, the operation of the propulsion apparatus of the miner vehicle, the operation of the nodule pick-up apparatus, the operation of the nodule washing apparatus, the operation of the nodule conveyor apparatus, and the operation of the nodule crusher apparatus.

The controls include electrical, electronic and hydraulic controls. The operations which are actively controlled include: initial placement of the miner vehicle in the mining area; the speed and direction of movement of the minver vehicle; the depth to which the rake of the pick-up penetrates the ocean bottom; the angle of inclination of the pick-up to the ocean bottom; the amount of soil or mud picked up with the nodules; the separation of the nodules from the soil or mud; the transport of the nodules to the crusher; the crushing of the nodules; the recovery of fines; the avoidance of obstacles; the rejection of nodules or other objects above a certain size; and the positioning of the ship to follow the movement of the miner vehicle as required.

Control consoles located on a surface ship form part of the control subsystem and provide the active control for all aspects of the mining operation from the surface ship.

The ocean mining system of the present invention comprises a surface subsystem and an ocean bottom subsystem.

In a specific embodiment of the present invention, the ocean bottom subsystem comprises a miner vehicle, a buffer and a flexible linkage between the miner vehicle and the buffer.

The surface subsystem includes a surface ship which functions to provide all operational control and maintenance support for the ocean bottom subsystem.

The surface ship deploys a pipe string downwardly from the surface ship until the lower end of the pipe string is positioned a relatively short distance above the ocean floor, and the ocean bottom subsystem is associated with this lower end of the pipe string.

The buffer is connected directly to the lower end of the pipe string; and in a specific embodiment of the present invention, the connection between the lower end of the pipe string and the buffer provides a limited amount of articulation.

The buffer is connected to the miner vehicle by the flexible linkage, and the flexible linkage is long enough to permit the vehicle to operate beneath the end of the pipe string within an area having a boundary envelope determined by the flexible linkage.

In a specific embodiment of the present invention, the miner vehicle indludes archimedes screw propulsion means which provide simplicity of construction, good bearing capabilities, good traction and high propulsion efficiency over a wide range of soil properties and bottom topographic conditions which can be encountered in a given mining area.

To minimize the bearing and propulsion requirements of the miner vehicle, all equipment not needed on the miner vehicle itself is located on the buffer.

The buffer includes a storage hopper for temporarily storing the nodule slurry pumped to the buffer from the miner vehicle. A feeder mechanism on the buffer feeds the nodule slurry from the buffer storage to a lift system at a controlled rate. Major pieces of equipment are located in an equipment section of the buffer. In a specific embodiment of the present invention, this equipment includes a salt water driven hydraulic unit, an electrically driven hydraulic power unit, two electrical transformers, a hydraulic valve box, and a pressure cylinder containing electronic components. The buffer also includes a transition section to which the flexible linkage is attached.

The flexible linkage isolates the miner vehicle from the dynamics of the buffer and pipe string. In a specific embodiment, the flexible linkage comprises two load carrying nylon ropes separated by spreader bars, a buoyancy block for holding the flexible linkage up above and out of the way of the miner vehicle, an electrical cable, hydraulic lines and a nodule slurry hose.

The nodule pick-up and handling apparatus includes a rake having laterally spaced tines which are positionable to engage the soil of the ocean floor at a controlled angle and to a controlled depth to cushion the pick-up of the nodules. The rake picks up a controlled amount of ocean bottom soil or mud with the nodules to minimize the breaking off of particles from the nodules during the pick-up operation.

A conveyor transports the picked up nodules from the rake and to a crusher. The conveyor is constructed to stabilize the nodules on the surface of the conveyor so that the nodules can be vigorously washed by water jets before the nodules are fed to the inlet of the crusher.

A stripper mechanism is associated with the conveyor at the inlet to the crusher to actively strip all the nodule material off of the conveyor and to thereby prevent loss of nodule material at this point of the nodule handling operation.

The crusher is controllable to crush the nodule material to a selected size, and this nodule material is then pumped as a nodule slurry, through a nodule slurry hose of the flexible linkage, to the temporary storage in the buffer.

In a specific embodiment of the present invention, the feeder mechanism of the buffer which feeds the nodule slurry from the buffer storage to a lift system is constructed with spiraled vanes which minimize possible jamming of this feeder mechanism.

The nodule slurry is lifted through the pipe string to the surface ship. The present invention utilizes one of three lift systems—an airlift, an electrically driven pump system, and a pressurized water lift system—depending upon the circumstances of the particular mining operation.

Other and further objects of the present invention will be apparent from the following description and claims and are illustrated in accompanying drawings which, by way of illustration, show preferred embodiments of the present invention and the principles thereof and what are now considered to be the best modes contemplated for applying these principles. Other embodiments of the invention embodying the same or equivalent principles may be used, and structural changes may be made as desired by those skilled in the art without departing from the present invention and the purview of the appended claims.

BRIEF DESCRIPTION OF THE DRAWINGS

FIG. 6 is taken along the line and in the direction indicated by the arrows 6—6 in FIG. 5.

FIG. 8 shows details of a stripper mechanism for removing nodules from the linked belt conveyor.

FIG. 14 is an isometric view showing details of the propulsion system for the miner vehicle. FIG. 14 also illustrates how blocks of buoyancy material are selectively located on the miner vehicle for providing controlled buoyancy and balancing of the miner vehicle.

FIG. 15 is a fragmentary, side elevation view, partly broken away in cross section to show details of an inner syntactic foam construction, of one of the propulsion screws of the propulsion system shown in FIG. 14. The flights of the propulsion screw shown in the FIG. 15 embodiment are straight, blade type flights.

FIGS. 16 and 16A are fragmentary, side elevation views like FIG. 15 but showing another embodiment of the propulsion screw. In the FIG. 16 embodiment the flights are triangular shaped flights in cross section and in FIG. 16A the fore and aft face angles are varied.

FIG. 17 is an isometric view of the flexible linkage between the miner vehicle and the buffer and illustrates how a flotation block keeps the flexible linkage suspended above and out of the way of the miner vehicle during the mining operation.

FIG. 18 is a side elevation view, taken along the line and in the direction indicated by the arrows 18—18 in FIG. 17, of one of the spreader bars included in the flexible linkage of FIG. 17.

FIG. 20 is partly broken away to show the location of a star feeder for feeding ore from the buffer storage to the lift system which conveys the ore to the ship.

FIG. 23 is a side elevation view showing how pipe sections of the pipe string are added at the ship as the miner vehicle is lowered from the ship to the ocean floor. FIG. 23 also shows how the airline of the air lift system is associated with the pipe string and also shows how the electrical control and power lines are associated with the added pipe sections.

FIG. 24 is a fragmentary, enlarged view of the part of FIG. 23 shown encircled by the arrows 24—24 in FIG. 23.

FIG. 25 is a plan view taken along the line and in the direction indicated by the arrows 25—25 in FIG. 24 and shows details of the connecting structure for connecting the air line to the pipe string in the air lift system.

FIG. 25A is an enlarged cross section view of the portion of FIG. 25 shown encircled by the arrows 25A—25A in FIG. 25.

FIG. 27 is a side elevation view showing the moon pool filled with sufficient water to float the flotation block high enough to suspend the flexible linkage above the miner vehicle. FIG. 27 illustrates the positioning of components of the underwater subsystem at the water to air interface just before the miner vehicle is lifted by the traction winch from the support blocks on the sliding door beneath the miner vehicle.

FIG. 28 is a side view like FIG. 27 but showing the bottom doors of the ship opened and the miner vehicle lowered through the opening provided by the opened doors.

FIG. 29 is a view like FIGS. 27 and 28 showing the miner vehicle lowered beneath the buffer through the full length of the flexible linkage and with the line from the traction winch disconnected from the traction winch and tied off to the flotation block and the buffer. In FIG. 29 the buffer also is shown lowered through and beneath the opening in the ship.

FIG. 30 illustrates, in dashed outline, the altitude sonar on the miner vehicle for sensing the distance between the miner vehicle and the ocean bottom and illustrates, in continuous line outline, the TV scanning for viewing the area of the ocean bottom to which the miner vehicle is being lowered.

As illustrated in FIG. 33 these methods and apparatus include a sonar system for determining the range and bearing of the miner vehicle with respect to the buffer, lights and TV cameras for looking at the terrain in front of and behind the miner vehicle, and lights and side scanning sonar associated with the buffer for providing early warning of obstacles to be avoided by the miner vehicle.

11 through 13. The schematic shown in FIG. 36 also incorporates the staged, electrically driven, centrifical pump shown in FIG. 22 for lifting the ore from the buffer storage to the ship.

DESCRIPTION OF THE PREFERRED EMBODIMENTS

Figures 1, 3:
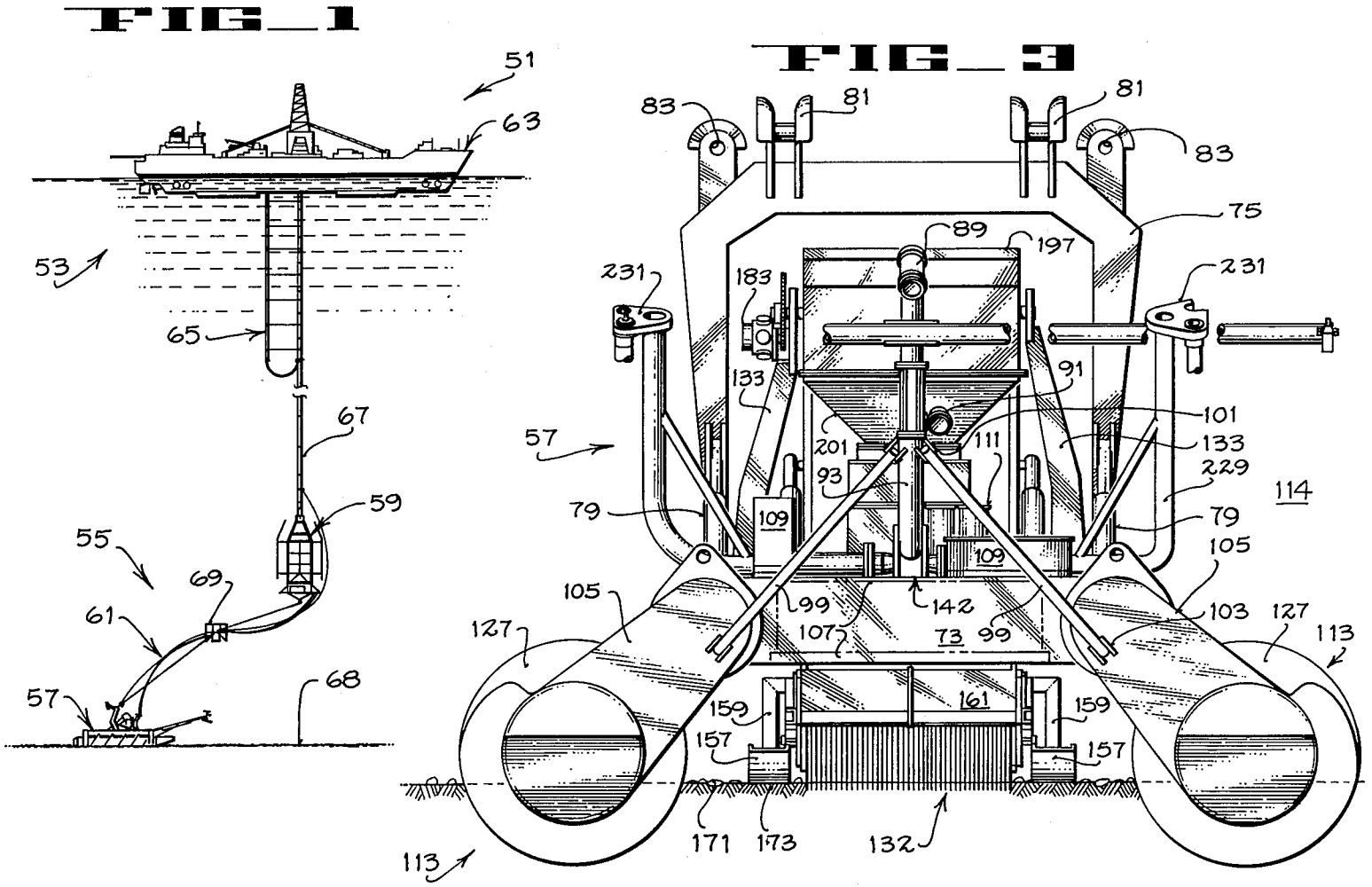
FIG. 1 is a side elevation view illustrating an ocean mining system constructed in accordance with one embodiment of the present invention.
FIG. 3 is an end elevation view of the miner vehicle and is taken along the line and in the direction indicated by the arrows 3—3 in FIG. 2.
Figure 35:
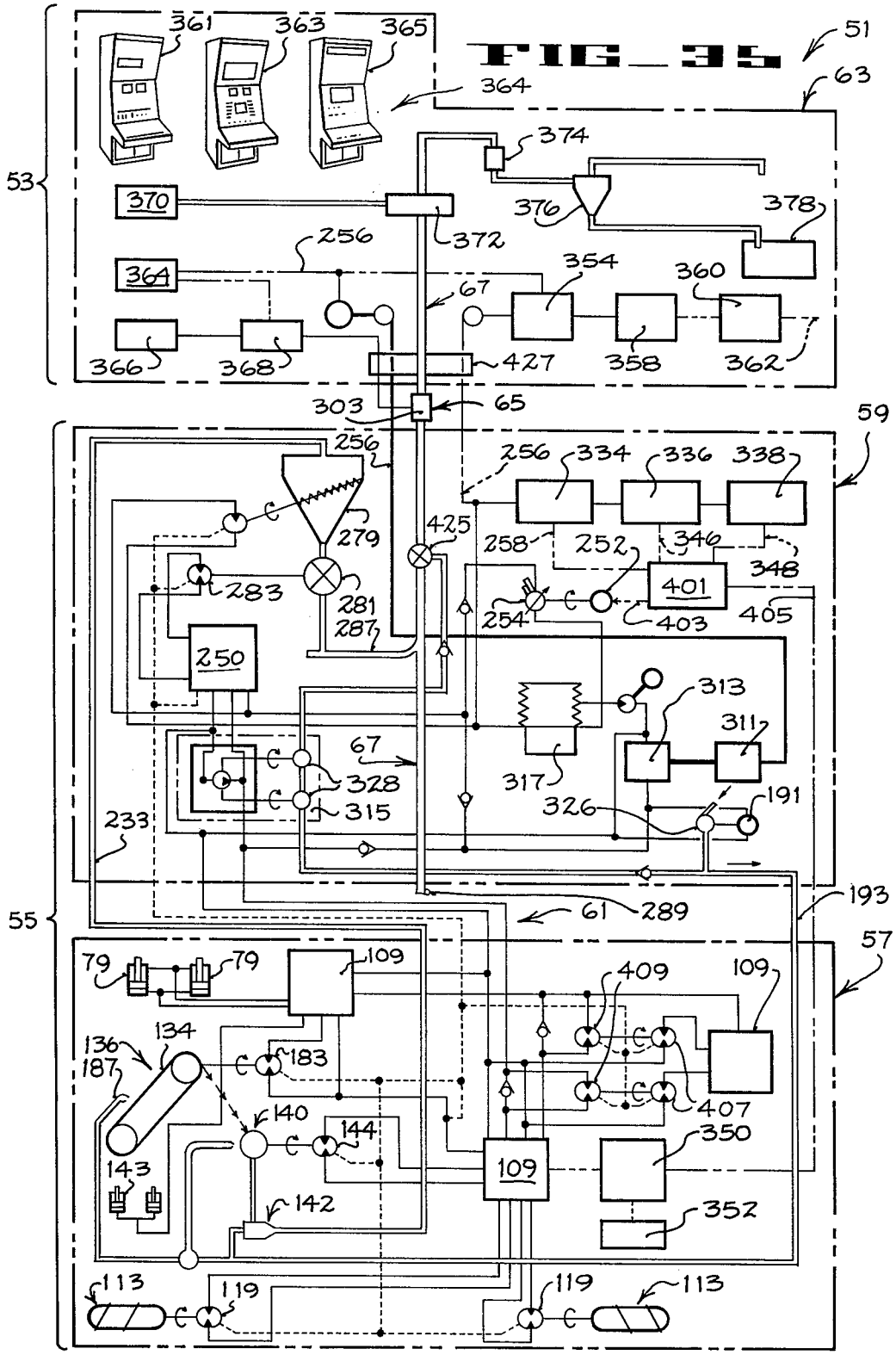
FIG. 35 is a schematic view illustrating the operative association between components of the embodiment of the mining system which incorporates the belt type conveyor illustrated in FIGS. 2 through 10.
Figure 36:
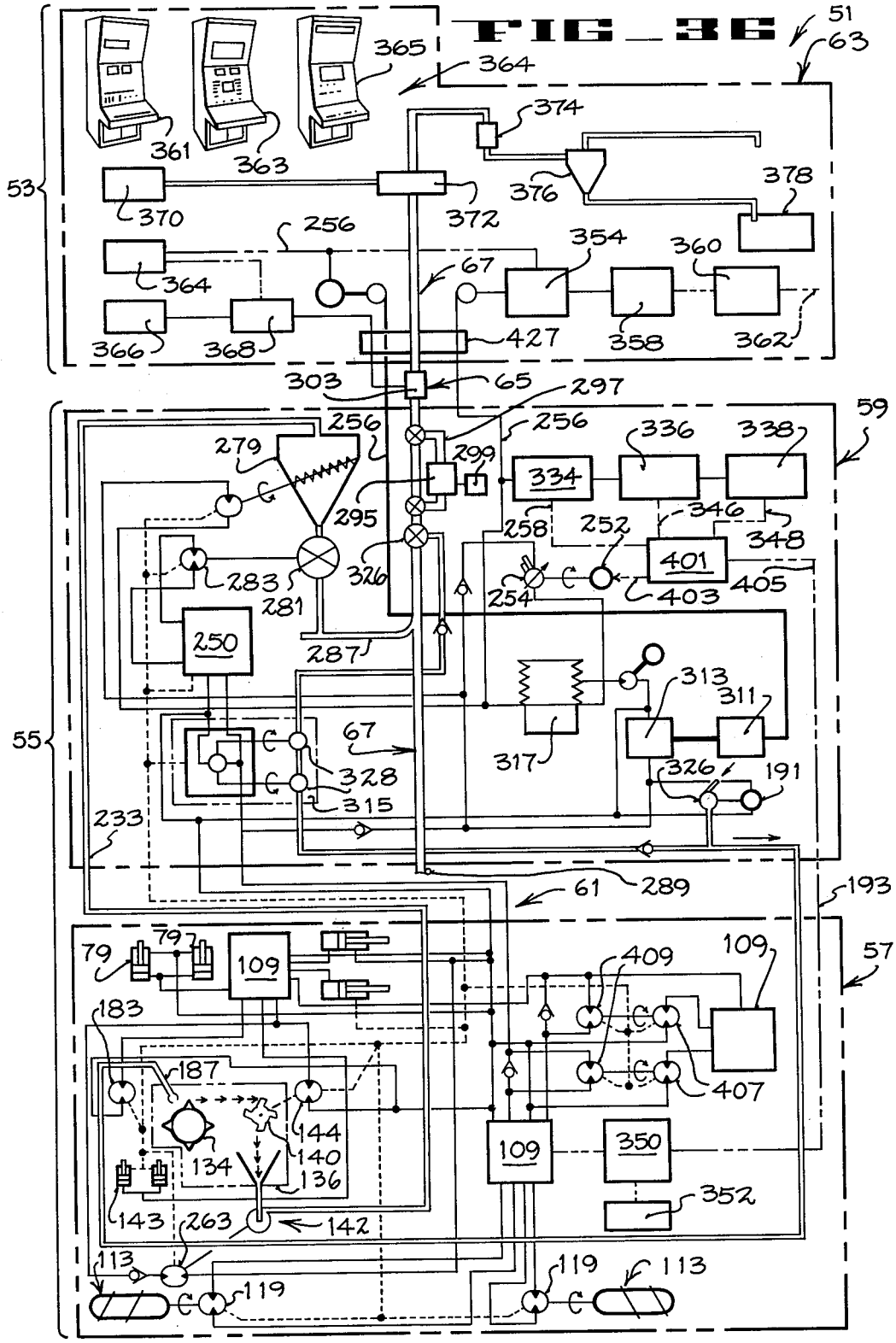
FIG. 36 is a schematic view like FIG. 35 but illustrating the operative association between components of the embodiment of the mining system which incorporates the nodule pick-up mechanism illustrated in FIGS.

One embodiment of an ocean mining system constructed in accordance with the present invention is indicated generally by the reference numeral 51 in FIGS. 1, 35 and 36 of the drawings.

The ocean mining system of the present invention comprises a maneuverable miner vehicle that picks up ferromanganese nodules from the ocean floor, washes and crushes the nodules. The crushed nodules are then lifted in the form of a slurry to a surface ship.

The mining system 51 comprises a surface subsystem 53 and an ocean bottom or underwater subsystem 55.

The underwater subsystem 55 functions to provide a mobile, maneuverable apparatus which operates with high efficiency to pick up, handle, wash, and crush the nodules while retaining nodule fines.

The surface subsystem 53 functions to provide all operational control and maintenance support for the underwater subsystem 55.

As illustrated in FIGS. 1 and 35, the mining system 51 comprises the following major functional components.

The underwater subsystem 55 includes a miner vehicle 57, a buffer 59, and a flexible linkage 61 between the miner vehicle 57 and the buffer 59.

The surface subsystem 53 includes a ship 63 and, in the embodiment illustrated in FIG. 1, an airlift 65 for lifting the nodule slurry to the ship.

The miner vehicle 57 is a maneuverable vehicle which typically operates some 12,000 to 18,000 feet below the surface. It picks up manganese nodules from the ocean floor, washes mud from the nodules, crushes the washed nodules to slurry, and pumps the slurry into a temporary storage in the buffer 59.

The miner vehicle 57 includes archimedes screw propulsion means (described in detail below with reference to FIGS. 14–16) which enable the miner vehicle to be highly mobile and to navigate ocean bottom terrain of varied topography. The propulsion means also provide a high degree of maneuverability and resultant mining efficiency by enabling the miner vehicle to position the nodule pick-up mechanism (described in detail below with reference to FIGS. 6–10 and FIGS. 11–13) accurately with respect to a previously mined swath. This maneuverability, in combination with the sensors and control subsystem, enable the miner vehicle to avoid obstacles which have the potential of causing damage to the nodule pick-up mechanism and miner vehicle.

The archimedes screw propulsion means provide simplicity of construction, good bearing capabilities, good traction and high propulsion efficiency over a wide range of soil properties and bottom topographic conditions which can be encountered in a given mining area.

To minimize the bearing and propulsion requirements of the miner vehicle, all equipment not needed on the miner vehicle itself is located on the buffer 59.

Figure 20:
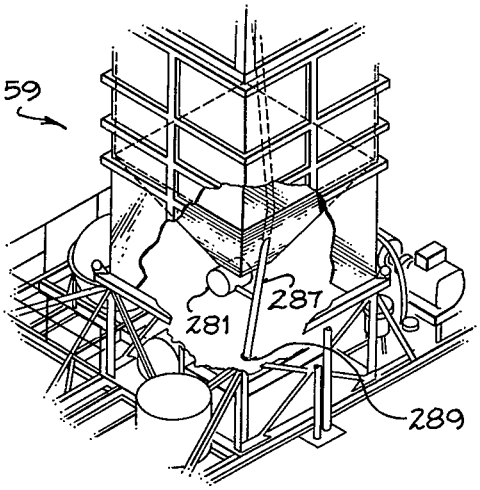
FIG. 20 is a fragmentary, isometric view of the lower part of the buffer shown in FIG. 19.
Figure 21:
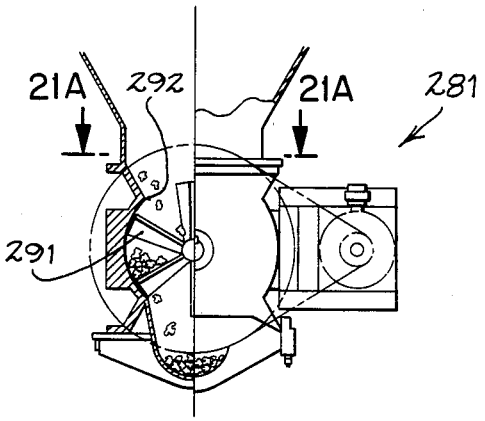
FIG. 21 is an elevation view, partly in cross section, showing details of the construction of the star feeder of FIG. 20.

The buffer 59 is a structure which is attached to the lower end of the pipe string 67 and is normally positioned about seventy-five feet above the ocean floor 68. The buffer includes a storage hopper for storing nodule slurry pumped to the buffer from the miner vehicle. The buffer also comprises a star feeder mechanism (described in more detail below with reference to FIGS. 20 and 21) for feeding the nodule slurry to a lift system at a controlled rate.

In the embodiment of the invention illustrated in FIG. 1 the lift system is an airlift 65 which lifts the nodule slurry from the buffer 59 through the lift pipe provided by the pipe string 67.

In addition to providing storage capacity the buffer 59 contains equipment not required on the miner, such as hydraulic power, electric power and a pressure vessel for electronics.

As will be described in greater detail below with reference to FIGS. 19, 20, 26, 33 and 35 the buffer structure includes a split clevis block, a gimbal ring, a truss, a buffer storage section, an equipment section and a transition section.

The gimbal ring and clevis block provide an articulated connection to the pipe string 67 which allows pitch and roll angles of plus or minus twenty degrees.

The storage section of the buffer includes a conical feed section, and a variable speed star vane feeder is attached to the bottom of the conical feed section for feeding a measured input of the stored nodule slurry into the lift system.

All major pieces of equipment are located in the equipment section of the buffer, including a salt water driven hydraulic power unit, an electrically driven hydraulic power unit, two electrical transformers, a hydraulic valve box, and a pressure cylinder containing all electronic components.

A transition section is located below the equipment section of the buffer and linkage strength members for the flexible linkage 61 are attached to the transition section.

The flexible linkage 61 isolates the miner vehicle 57 from the dynamics of the buffer 59. As will be described in greater detail below with specific reference to FIGS. 17 and 18, the flexible linkage comprises two load carrying nylon ropes separated by spreader bars, a buoyancy structure or block 69 and six hoses. The hoses include a salt water pressure hose, a slurry return hose, a hydraulic pressure hose, a hydraulic return hose, a hydraulic drain hose, and an electrical umbilical hose which is constructed to be internally pressure compensated by oil pressure compensators of the underwater subsystem 55.

The surface subsystem comprises, in the embodiment shown in FIG. 1, the ship 63 and the airlift 65.

The airlift 65 will be described in more detail below with reference to FIGS. 23–25. The airlift lift system is one of three lift system embodiments for lifting the nodule slurry from the buffer 59 to the ship 63.

A second embodiment of the lift system uses high pressure water pumped to the buffer from the ship by pumps located in the ship. In the embodiment of the ocean mining system 51 shown in FIGS. 1 and 35 this high pressure water lift system is used as a back up system for the mining operation.

Figure 22:
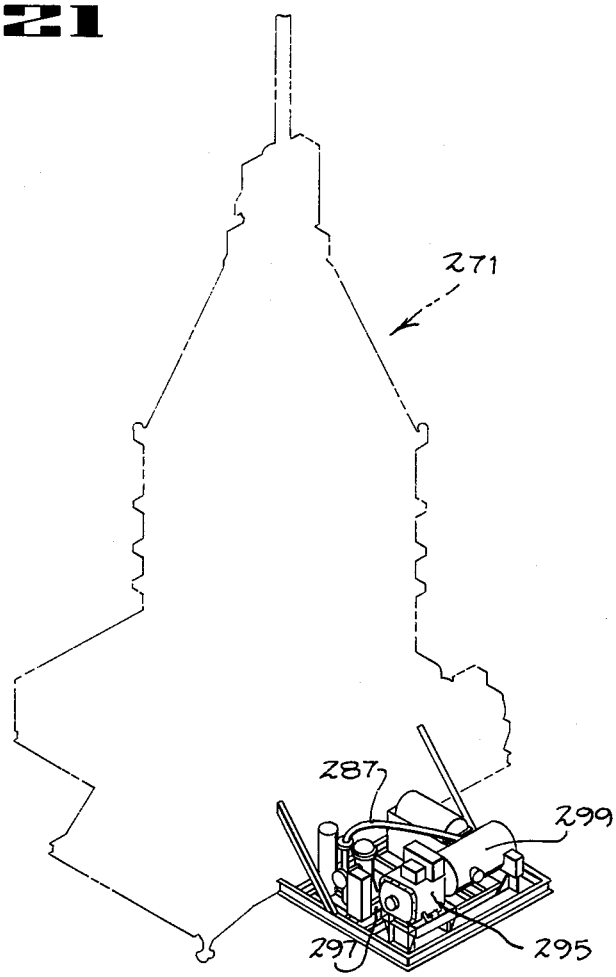
FIG. 22 is an isometric view of another embodiment of a pump for pumping ore from the buffer storage to the ship. The pump shown in FIG. 22 is a staged, electrically driven centrifical pump which is used in place of the air lift system shown in the FIGS. 23–25 embodiment.

A third embodiment of the lift system is shown in FIGS. 22 and 36 and incorporates staged, electrically driven lift pumps located on the buffer (as will be described in greater detail below with reference to FIGS. 22 and 36).

The ship 63 incorporates a number of components (described in greater detail below with reference to FIGS. 23, 26–29 and 35) for deploying and operating the underwater or ocean bottom subsystem. These components include: a derrick; a heave compensator; a gimbal; pipe handling; pipe storage; pipe; umbilical cable handling; umbilical cable storage; umbilical cable; fore, aft, and side thrusters; a traction winch and control consoles.

The control consoles form part of a control subsystem for actively controlling all aspects of the mining operation (as will be described in greater detail below with reference to FIGS. 30 and 33–35).

The operations which are actively controlled include: initial placement of the miner vehicle in the mining area; the speed and direction of movement of the miner vehicle; the depth to which the rake of the pick-up penetrates the ocean bottom; the angle of inclination of the pick-up to the ocean bottom; the amount of soil or mud picked up with the nodules; the separation of the nodules from the soil or mud; the transport of the nodules to the crusher; the crushing of the nodules; the recovery of fines; the avoidance of obstacles; the rejection of nodules or other objects above a certain size; and the positioning of the ship to follow the movement of the miner vehicle as required.

The present invention includes two embodiments of mechanisms for picking up, transporting, washing, and crushing nodules.

One embodiment uses a belt type conveyor and will be described in detail below with reference to FIGS. 6–10 and 35.

The other embodiment uses a drum type conveyor and will be described in detail below with reference to FIGS. 11–13 and 36.

The miner vehicle 57 as shown and illustrated in FIGS. 2–5 incorporates the nodule pick-up mechanism shown in FIGS. 6–10, and the construction and operation of this embodiment of the miner vehicle 57 will now be described with reference to FIGS. 2–10, 14–16, and 35.

The miner vehicle 57 comprises a vehicle part (a main frame and a propulsion mechanism) and a nodule pick-up and handling part which is carried by the vehicle part.

As illustrated in FIGS. 2 through 5, the vehicle 57 has a main frame which includes two tubular, longitudinally extending members 71 and three cross members 73.

Figures 2, 4:
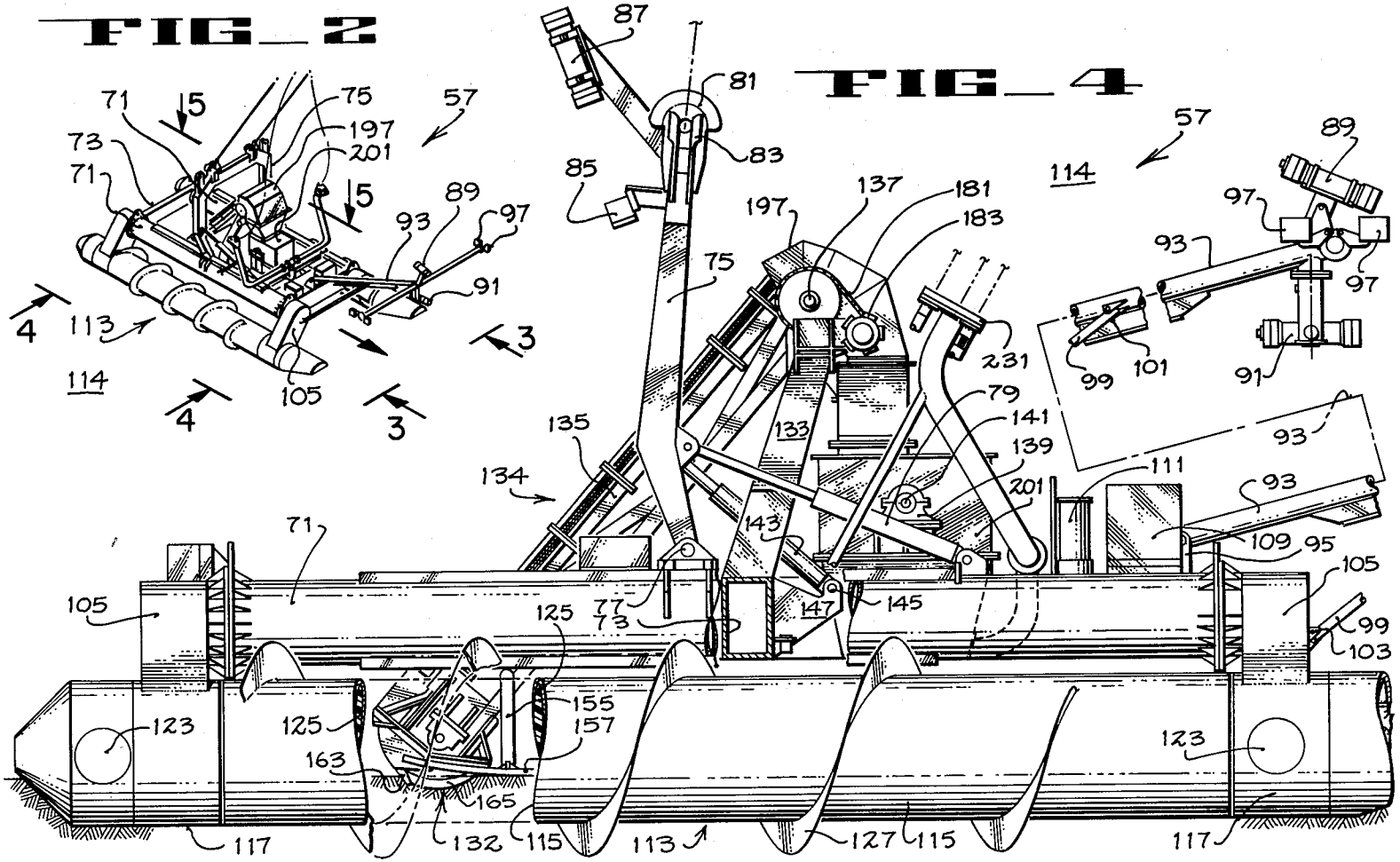
FIG. 2 is an isometric view of a miner vehicle which forms a part of the underwater subsystem of the mining system shown in FIG. 1.
FIG. 4 is a side elevation view of the miner vehicle and is taken along the line and in the direction indicated by the arrows 4—4 in FIG. 2.

A lift frame 75 is connected to the main frame by pivotal connections 77 at the lower end of the lift frame (see FIG. 4). The lift frame 75 is pivotable about the pivotal connections 77 to the various positions shown in FIGS. 30–33 (as will be described in more detail below with reference to these Figs.).

The angular position of the lift frame 75 with respect to the main frame is controlled by a pair of hydraulic cylinders 79 (see FIG. 4).

These lift frame cylinders 79 are in turn controlled by a vehicle control console located on the ship 53 (as will be described in greater detail below with reference to FIG. 35).

The lift frame 75 has two lugs 81 (see FIG. 3) at the top of the lift frame, and five inch nylon lines from the flexible linkage 61 are connected to these lugs 81 (see FIG. 17).

A pair of lifting eyes 83 are also attached to the top of the lift frame 75. A deployment lift line is connected to each of these lift eyes 83 (see FIGS. 26–29) for lifting the miner vehicle 57 by a traction winch during deployment of the underwater or bottom subsystem 55 from the ship 63 (as will be described in more detail below with reference to FIGS. 26–29).

As illustrated in FIG. 4, a light 85 is attached near the top of the lift frame 75, and a TV camera 87, mounted on a pan and tilt mechanism, is also attached to the top of the lift arm 75. The light 85 and TV camera 87 look down and aft and enable an operator at one of the control consoles (shown in FIG. 35) on the ship to view and to control the nodule pick-up, transport, washing and crushing operations and also the action of the propulsion mechanism on the ocean bottom.

Each operator at each of the three control consoles shown in FIG. 35 can switch on the camera 87 on one of thescreens on his particular console to assist in that operator's control of the mining operation (as will be described in more detail below with reference to FIG. 35 and FIG. 33).

Two forward looking TV cameras 89 and 91 are mounted on pan and tilt mechanisms at the end of a forwardly extending boom 93 pivotally mounted at 95 (see FIG. 4) to the vehicle main frame at the front end of the vehicle 57.

Lights 97 are also mounted on this forwardly extending boom 93.

A pair of braces 99 are pivotally connected at 101 to the boom 93 and are pivotally connected at 103 to pylons 105 (see FIG. 5) forming part of the vehicle main frame.

Figure 5:
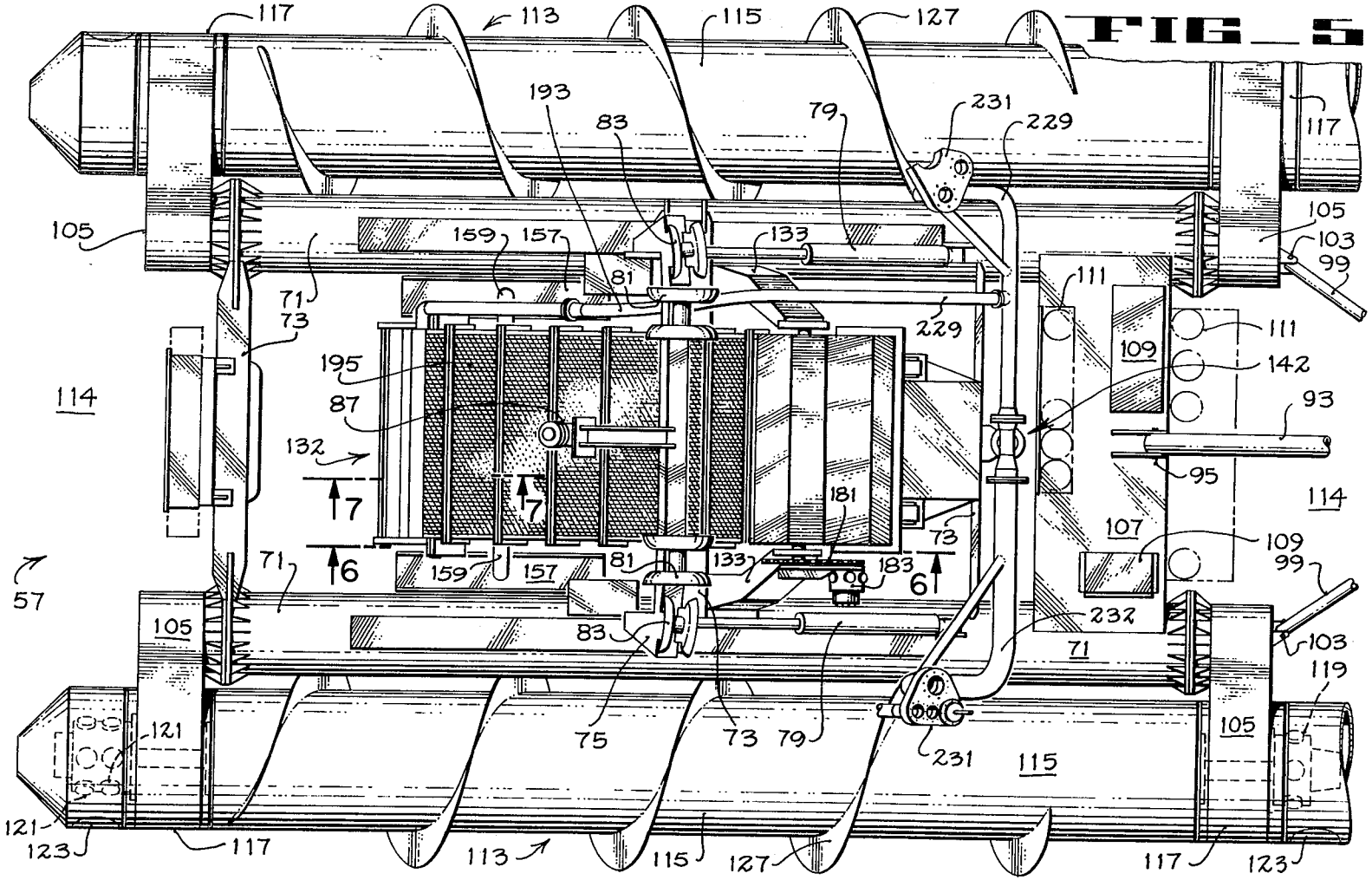
FIG. 5 is a top plan view of the miner vehicle and is taken along the line and in the direction indicated by the arrows 5—5 in FIG. 2.

An equipment tray 107 is mounted on the main frame of the vehicle near the forward cross member 73 (see FIGS. 3 and 5).

A box 109 containing electrically operated hydraulic control valves and related apparatus for the miner vehicle hydraulic cylinders and rotary drive motors is mounted on the equipment tray 107.

A number of oil filled pressure compensating cylinders 111 are also mounted on the equipment tray for pressurizing the interior of certain vehicle components, such as the box 109, in response to the increased pressure of the surrounding water 113 at whatever particular depth the miner vehicle 57 is operating. The cylinders 111 contain oil filled bags which are exposed to the ambient water pressure so that the oil within the bags is pressurized to the same pressure as the ambient water pressure; and this pressure within the oil filled bags is then transmitted to the interior of the other vehicle components, such as the box 109, to balance the interior pressure of such components against the exterior pressure exerted by the surrounding water 114.

Figures 14, 14A, 15, 16:
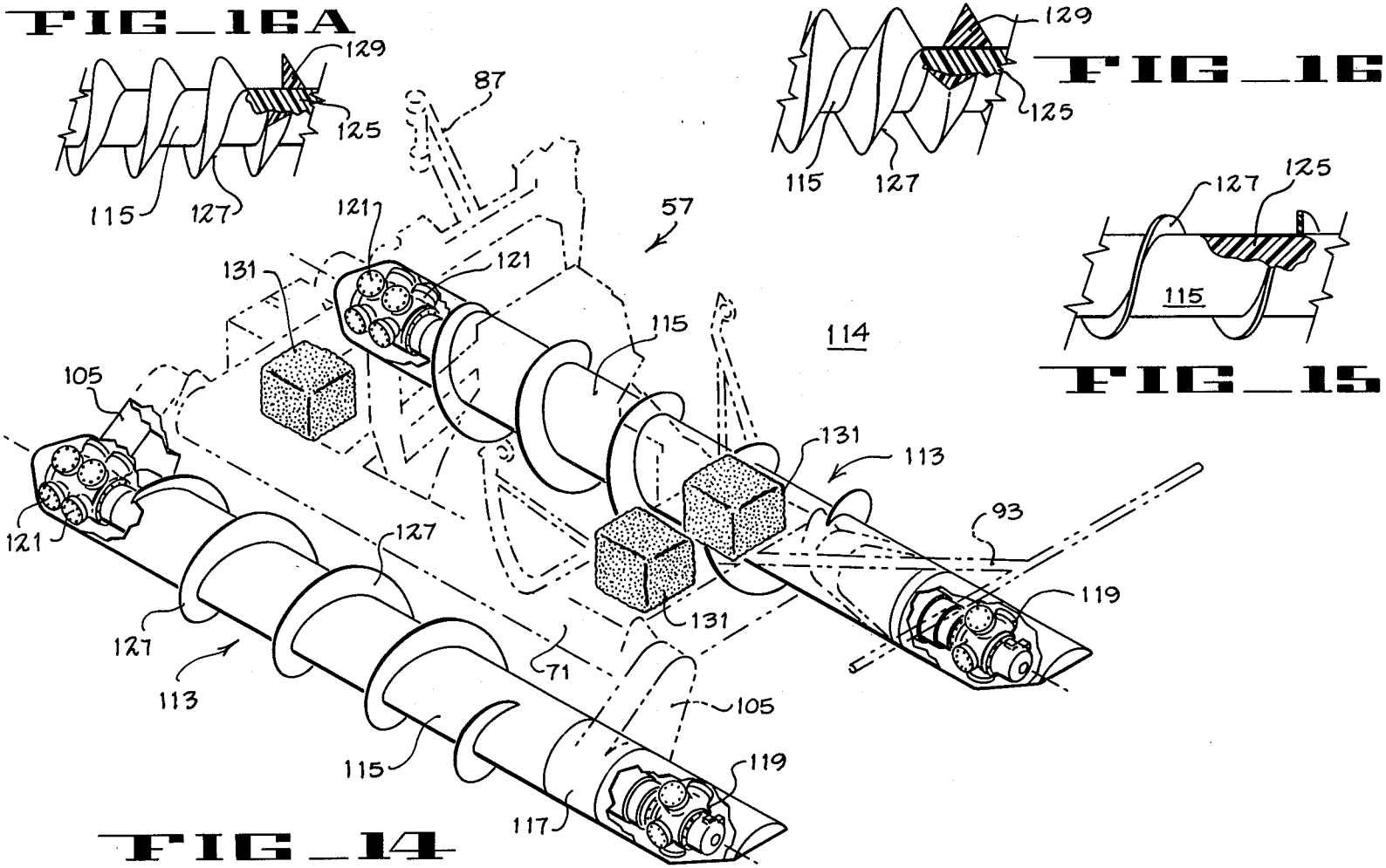

As noted above, the propulsion means include a pair of archimedes screws. These propulsion means are best illustrated in FIGS. 14–16 where each archimedes screw is indicated by the reference numeral 113.

Each screw 113 includes a cylindrical drum section 115.

Each drum 115 is mounted for rotation within a bearing housing 117 at the lower end of each pylon 105.

Either direct drive or geared hydraulic motors may be used fore and aft on each drum 115. In the particular embodiment illustrated in FIG. 14, a single geared hydraulic motor 119 is connected to the front end of each drum 115, and a direct drive hydraulic motor 121 is connected to the aft end of each drum 115. The motors rotate the screw 113 in a selected direction and at a selected speed of rotation under the control of an operator or operators on board the ship 63 at one or more of the three control consoles shown in FIG. 35.

As illustrated in FIG. 4, the bearing housings 117 and drums 115 have access panels 123 which are removable for access to the motors and bearings.

Each drum 115 is filled with a syntactic foam (a plastic form 125 containing small, hollow, glass spheres). This syntactic foam is a lightweight material which provides a positive buoyancy and which also contributes substantial strength against compression.

Each drum 115 thus provides a positive buoyancy to the miner vehicle 57.

Each drum 115 also distributes the underwater weight of the miner vehicle over a substantial bearing area on the ocean bottom because of the diameter and length of the drum which provides flotation on the ocean bottom.

Traction for foward, aft, and turning movement of the miner vehicle is provided by a spiraled flight 127 on each screw 113.

In the embodiment shown in FIGS. 14 and 15, the flight 127 is a straight, blade type flight used with a drum 115 of relatively large diameter.

In the embodiment shown in FIG. 16, the flight 127 is triangular shaped in cross section so that the flight itself presents a projected area for engaging the ocean bottom, and the drum 115 is of smaller diameter than the drum 115 of the FIG. 15 embodiment and therefore presents less surface for frictional, sliding engagement with the ocean bottom.

The interior of the triangular flight 127 of the FIG. 16 embodiment is also filled with a syntactic foam 129.

The particular screw 113 configuration used in the given application is dependent upon the soil characteristics of the ocean bottom at that location.

As illustrated in FIGS. 14 and 35, the flights 127 are oppositely spiraled on the screws 113, and the screws 113 are driven in opposite directions of rotation so that the vehicle maintains a true straight line direction when both screws are being driven at the same speed of rotation without any tendency to veer to one side or the other, as would be the case if both screws were constructed for rotation and were rotated in the same direction to produce forward or rearward drive of the miner vehicle.

As illustrated in FIG. 14, additional buoyancy blocks 131 are attached to selected locations on the main frame to provide controlled buoyancy and balancing of the miner vehicle 57.

The nodule pick-up and handing mechanism of the miner vehicle 57 includes the following components: a rake type pick-up 132 (see FIG. 9) for lifting the nodules (and a selected amount of cushioning mud) from the ocean floor; a conveyor 134 (see FIG. 6) for transferring the picked-up nodules from the rake to a conveyor surface and for holding the nodules in a stabilized position on the conveyor surface while subsequently conveying the nodules first to a washer and then to a crusher; a washer 136 (see FIG. 7) for separating the nodules from the picked-up mud and for removing the mud from the conveyor surface; a stripper 138 (see FIGS. 8 and 10) for removing the nodules from the conveyor surface at the inlet to the crusher; a crusher 140 (see FIG. 6) for crushing the nodules to a nodule slurry; and a pumping mechanism 142 (a jet pump in the FIG. 35 embodiment) for pumping the nodule slurry from the miner vehicle 57 to the buffer 59 storage.

In the embodiment illustrated in FIGS. 2–10, a single, rake-type, nodule pick-up 132 and associated nodule handling mechanism are used, and this pick-up and associated mechanism are located in the interior of the miner vehicle between the propulsion screws 113.

Figure 11:
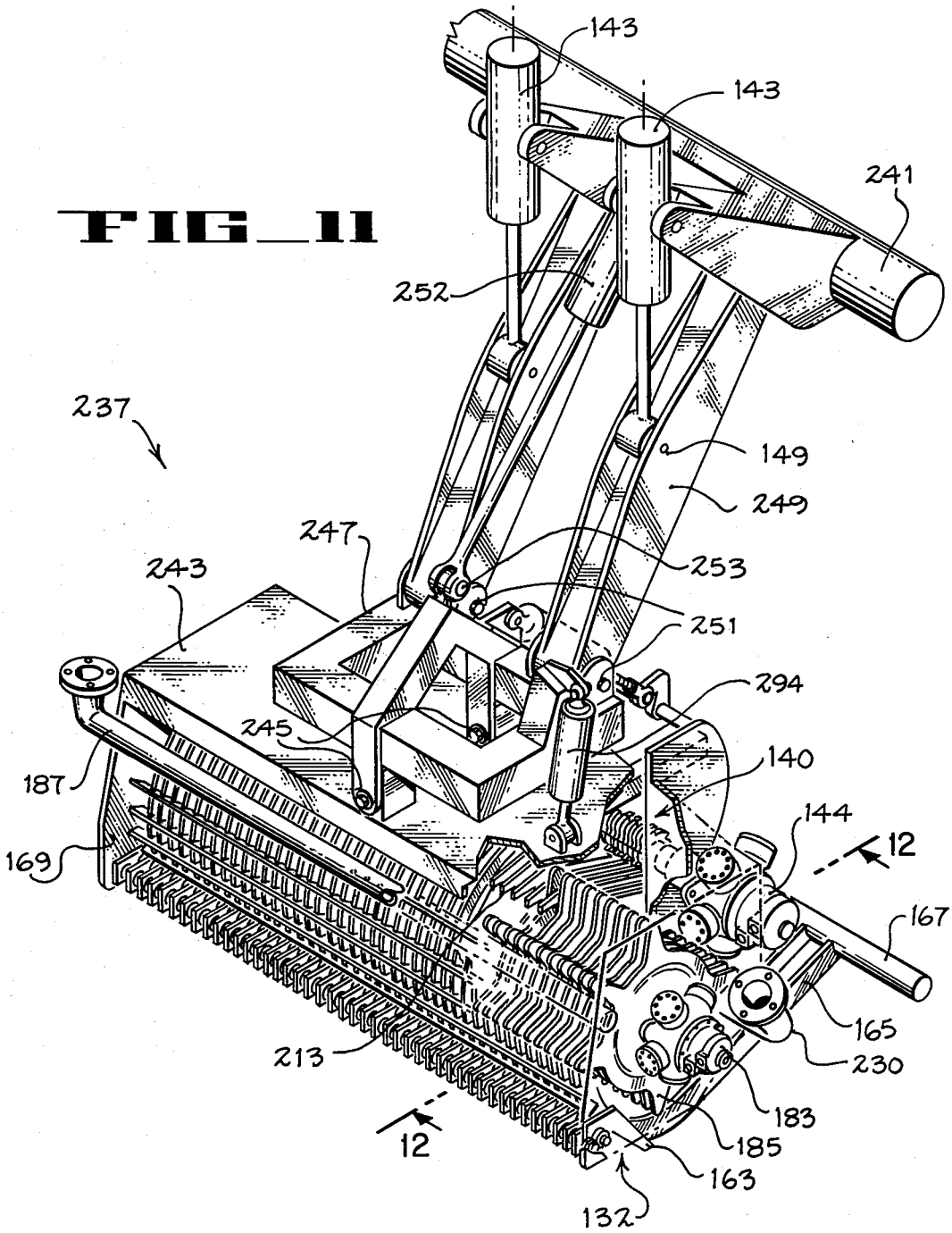
FIG. 11 is an isometric view, taken along the line and in the direction indicated by the arrows 11—11 in FIG. 13, of another embodiment of a nodule pick-up and crusher mechanism for the miner vehicle. The nodule pick-up and crusher mechanism shown in FIG. 11 is used as one of a number of ganged pick-ups as illustrated in FIG. 13.
Figure 12:
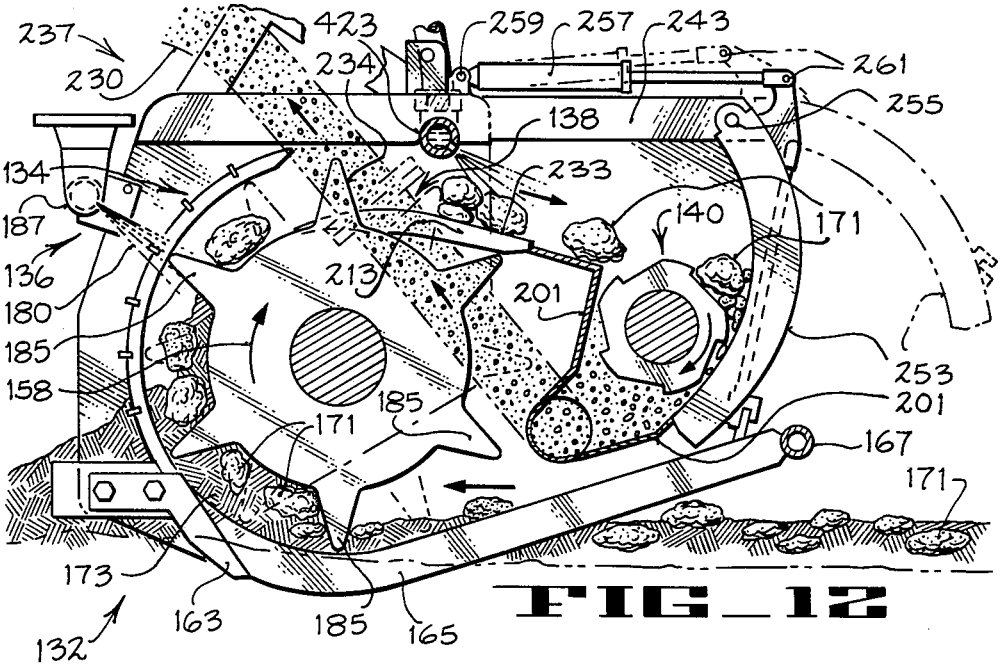
FIG. 12 is a fragmentary, enlarged side elevation view, taken along the line and in the direction indicated by the arrows 12—12 in FIG. 11, showing details of the nodule pick-up, washing, transporting, and crushing mechanism. The phantom lines in FIG. 12 illustrate how a door of the crusher is opened for back flushing to clear jamming in the crusher.
Figure 13:
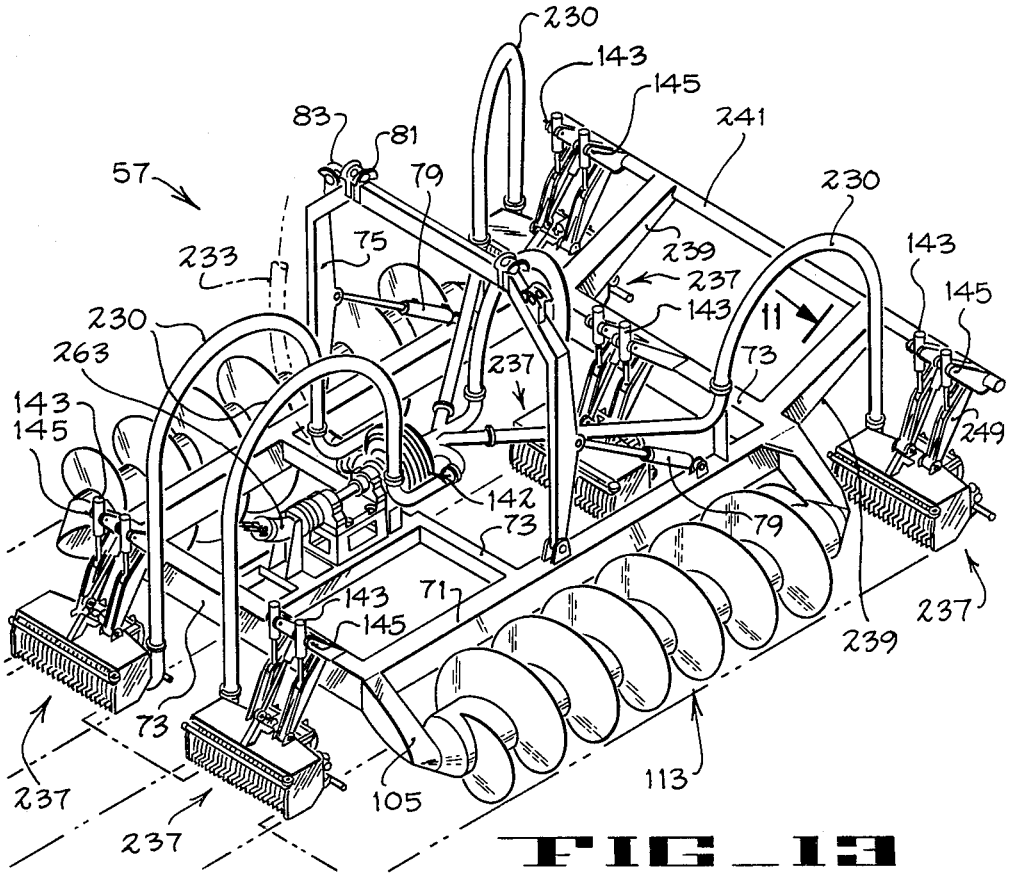
FIG. 13 is an isometric view showing how the multiple, ganged, pick-up and crushing mechanisms of FIG. 11 are mounted on the miner vehicle and how these mechanisms are manifolded to a common slurry pump for pumping crushed ore from the miner vehicle to the buffer.

In the embodiment illustrated in FIGS. 11-13, multiple, ganged nodule pick-ups are used for increased productivity.

Looking first at the embodiment illustrated in FIGS. 2–10, the nodule pick-up and handling mechanism includes a pair of support arms 133 for supporting a conveyor frame 135 about an upper pivotal connection 137.

The support for the crusher 140 includes a pair of trunnions 139 attached to the main frame 71 and supporting a rotatable drive shaft 141 of the crushing mechanism.

Figures 6, 7:
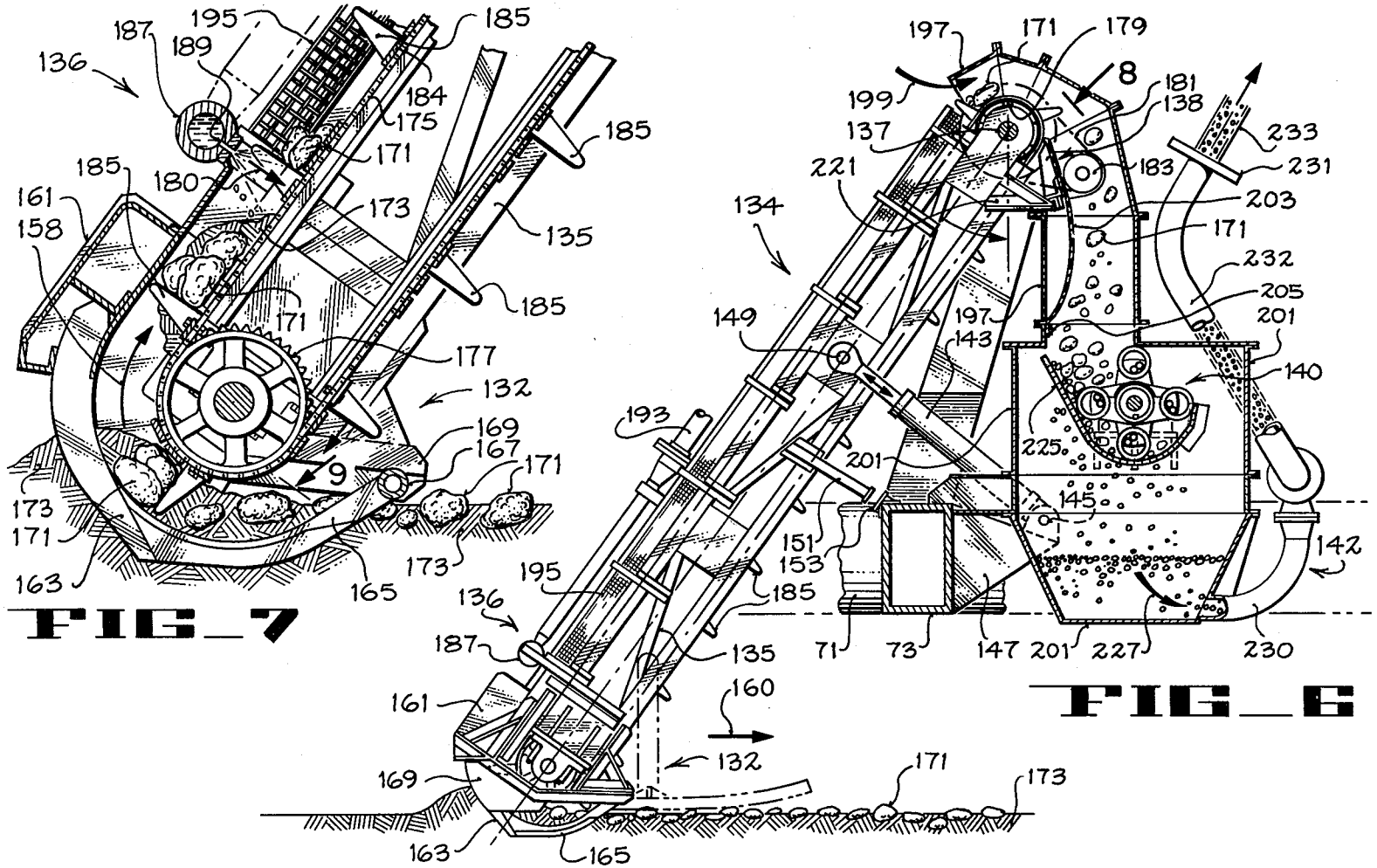
FIG. 6 is a fragmentary, enlarged, side elevation view, with some parts broken away to clarify illustration, of one embodiment of a nodule pick-up, conveyor and crusher mechanism incorporated in the miner vehicle.
FIG. 7 is a fragmentary, enlarged, side elevation view, taken along the line and in the direction indicated by the arrows 7—7 in FIG. 5, showing details of the rake, conveyor and nodule washing mechanism.

The angle at which the conveyor frame 135 is disposed with respect to the main frame of the miner vehicle is determined by a pair of hydraulic cylinders 143 (see FIG. 6). The lower end of each cylinder 143 is pivotally connected at 145 to a flange 147 attached to the central cross member 73. The outer end of the piston rod of each cylinder 143 is pivotally connected at 149 to the conveyor frame 135.

A stop member 151 on the conveyor frame 135 engages a corresponding stop number 153 on the main frame of the vehicle to limit the extent to which the conveyor frame can move toward the vertical with respect to the frame.

Two adjustable length struts 155 (see FIG. 4) have their upper ends connected to the frame 135 of the conveyor, and the outer ends of the struts 155 are connected to skids 157 (see FIGS. 2 and 4).

The adjustable length struts 155 thus serve to regulate the maximum depth to which the rake 132 of the nodule pick-up mechanism penetrates within the ocean bottom soil or mud.

The internal pressure within each cylinder 143 is controllable by an operator at one of the control consoles on the ship 63, to permit the lower end of the conveyor frame and associated nodule pick-up rake 132 to ride up and over objects above a certain, selected size.

Figure 9:
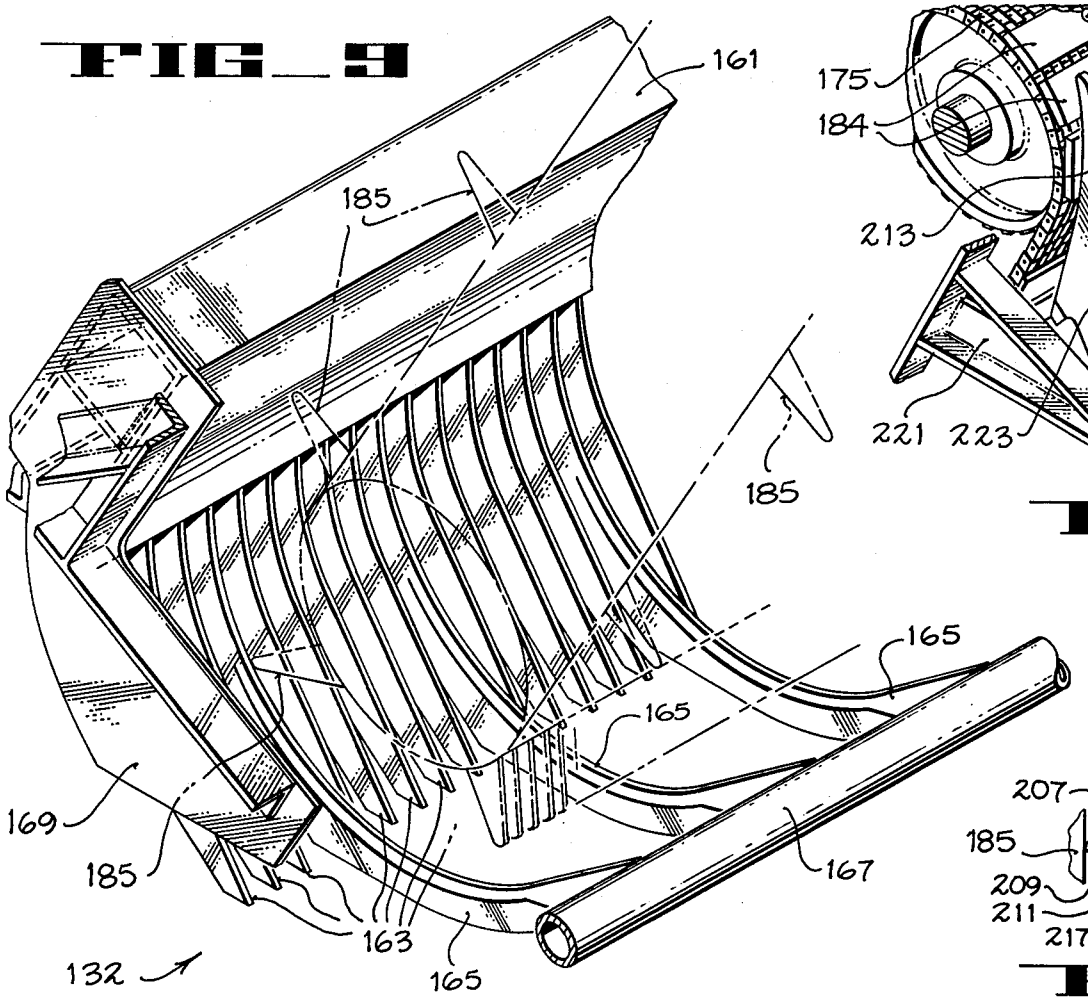
FIG. 9 is an isometric, enlarged view, taken in the direction indicated by the arrow 9 in FIG. 7, showing details of the skids and tines of the rake.

The construction and operation of the nodule pick-up rake 132 are best shown in FIGS. 9 and 7.

The rake 132 includes an enclosed frame section 161 and a number of downwardly and forwardly curved tines 163 and 165.

In the embodiment shown, every sixth tine is a longer tine 165, and the outer ends of the tines 165 extend in front of and slightly above the lowermost ends of the tines 163.

A tubular bar 167 is attached to the outer ends of the tines 165; and, as illustrated in FIG. 7, the ends of this bar 167 are connected to the conveyor frame 135 by plates 169.

These plates 169 partly enclose the sides of the rake 132 (see FIG. 9).

The effect of this structure in combination with the trailing angle at which the cylinders 143 position the conveyor frame 135 and rake 132 provide a cushioned pick-up of the nodules 171 within a selected range of maximum and minimum sizes.

Looking at FIG. 7, it will be apparent that the difference between the vertical positions of the horizontal bar 167 and the lower ends of the tines 163 serves to permit nodules only within a certain maximum diameter to be admitted into the rake 132. See FIG. 9.

The lateral spacing between the tines 163 and 165 exerts some control over the minimum size nodule that is picked up.

The angle at which the tines 163 and 165 engage the soil or mud 173 of the ocean bottom determines how much mud is picked up by the rake and how much of the mud is permitted to pass through the space between the tines of the rake. As illustrated in FIG. 7, the rake 132 actually causes the mud 173 to swell up a certain amount within the interior of the rake and this action assists the conveyor 134 in lifting the nodules 171 off the ocean bottom.

The conveyor 134 (in the embodiment shown in FIGS. 2-8) includes a belt 175 formed by small metal links connected together in pin joint connections and trained over a lower sprocket 177 (see FIG. 7) and an upper sprocket 179 (see FIG. 6).

The upper sprocket 179 is driven by a drive belt 181 and a hydraulic motor 183 (see FIGS. 5 and 6).

The belt 175 includes cross slats 184 having outwardly projecting fingers 185 (see FIGS. 8 and 7) which engage the nodules 171 and entrained mud within the interior of the pick-up rake and transport the mixture upward to the washer 136.

The speed of rotation (indicated by the arrow 158 in FIG. 7) of the belt 175 is correlated with the speed of forward movement (indicated by the arrow 160 in FIG. 6) of the rake 132 so that there is a minimum of relative longitudinal motion produced on the mixture of nodules and mud. This correlation of speed, in combination with the trailing attitude of the conveyor frame 135 and pick-up rake 132, minimizes the fanning of mud during the nodule pick-up operation. This is important in the mining system of the present invention because the pick-up is visually watched by an operator on board the surface ship, so that appropriate controls can be exerted on the miner vehicle to maximize efficiency of nodule pick-up, and any disturbance of the soil or mud on the ocean bottom makes observation and therefore the desired control that much more difficult.

The fingers 185 function to stabilize the position of the nodules 171 on the outer surface of the conveyor belt 175, and the washer 136 can therefore hit the nodules and entrained mud with a hard jet of water to separate the nodules from the mud and to cause the mud which had been entrained to flow through the open spaces in the linked belt 175. The washing jet of water is produced (in the direction of the arrow 180 in FIG. 7) by a manifold 187 and orifices 189 (see FIG. 7).

As illustrated in FIG. 35, the water for the manifold 187 is pumped from the buffer 59 by a salt water pump 326 driven by a hydraulic or electric motor 191.

The water pumped by the salt water pump 189 is transmitted by a hose 193 (see FIGS. 35 and 18), and water from this hose is also used to operate the jet pump 142 previously described for pumping the nodule slurry from the miner vehicle 57 to the buffer 59.

The length of the conveyor between the washer 136 and the stripper 138 at the inlet to the crusher 140 is covered by a screen 195 (see FIGS. 5 and 7) which minimizes loss of nodules 171 between these two points.

At the upper end of the conveyor 134 the nodules 171 enter the inlet end of a duct 197 connected to the crusher 140. There is a small space between the conveyor and the inlet end of the duct 197 at this point, and a positive inflow of water (in the direction indicated by the arrow 199) is maintained by the action of the jet pump 142. The jet pump 142 pumps the slurry of crushed nodules and water from the bottom of a housing 201 which encloses the crusher 140 and which is connected to the duct 197 (see FIG. 6). This inflow of water at 199 is another one of the features of the present invention which are utilized to maintain a high efficiency of recovery of the nodules and fines. In this case the positively induced inflow of water 199 prevents any substantial loss of fines because the inflow of water forces any suspended fines, or small nodules, to flow inward within the duct 197 and ultimately to the buffer storage.

Figure 8:
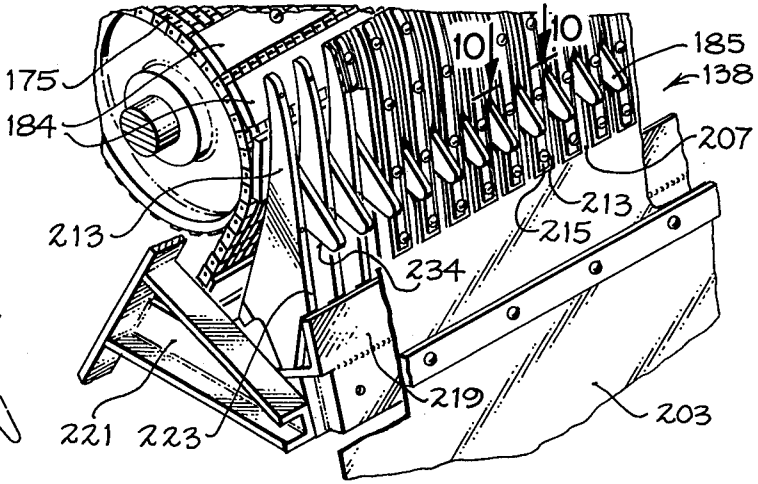
FIG. 8 is an isometric view, taken in the direction indicated by the arrow 8 in FIG. 6, of the upper end of the conveyor.
Figure 10:
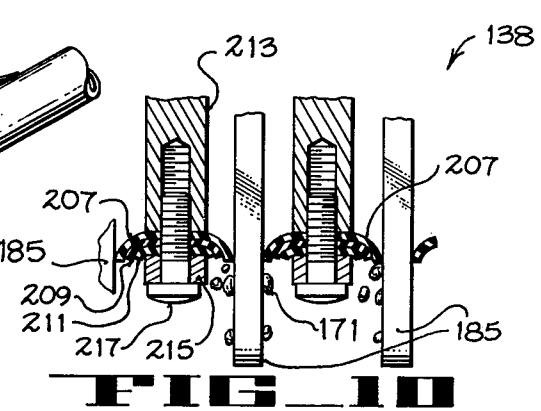
FIG. 10 is a fragmentary view, taken along the line and in the direction indicated by the arrows 10—10 in FIG. 8, showing details of the coaction between the stripper mechanism and the nodule engaging fingers of the conveyor.

The stripper 138 performs an active, positive removal of the nodules 171 from the conveyor belt 175, and the construction and operation of the stripper 138 can best be understood by reference to FIGS. 8, 10 and 6.

The stripper 138 comprises a flexible member 203 which has a lower edge attached at 205 to the interior of the duct 197 and which has an upper edge configured to extend in strips 207 between the laterally-spaced fingers 185 of the conveyor belt 175.

As best illustrated in FIG. 10 these flexible strips 207 physically engage the sides of the fingers 185 to actively wipe small nodule particles 171 off of these fingers 185 and to thereby cause these particles to be transmitted downwardly within the duct 197. This prevents these particles from going back out again on the underside of the conveyor 134.

As illustrated in FIGS. 8, 10 and 6, each strip 207 is supported by flexible back-up washers 209 and 211 and is attached to a metal support member 213 by a retainer 215 and a cap screw 217. The metal support members 213 are in turn mounted on a spacer bar 219 which extends across the width of the conveyor belt and which is mounted by brackets 221 to the conveyor frame 135. The curvature of the outer edge 223 of each support 213 is related to the shape of the leading edge 234 of each finger 185 in a way that prevents any scissor action between these two edges as the fingers 185 are rotated through the inter-leaved supports 213. This prevents any jamming or precipitous crushing of the nodules during the stripping operation. This will be described in greater detail below with reference to the FIG. 12 embodiment where the geometric relationship of these corresponding edges can be more clearly seen.

The crusher 140 in the embodiment shown in FIG. 6 is a hammer mill which crushes all of the nodules to a selected maximum size or smaller.

The hammer mill crusher 140 is driven by a hydraulic motor 144 (see FIG. 35).

The crushed nodules drop through perforations in a plate 225 (see FIG. 6) and accumulate at the bottom of the enclosure 201 where they are withdrawn, through a conduit 230 as indicated by the arrow 227, as a slurry of crushed nodules and water by the suction produced by the jet pump 142.

The slurry flows upward through the tubing 232 and through a coupling provided by one of the physical connectors 231 to a hose 233 of the flexible linkage 61 (see FIGS. 17 and 18) and to the buffer storage.

The embodiment of the nodule pick-up and handling mechanism shown in FIGS. 11–13, indicated generally by the reference numeral 237, includes many of the features described above with reference to the embodiment of the nodule pick-up and handling mechanism shown in FIGS. 2–10, and corresponding parts are indicated by like reference numerals.

Thus, the nodule pick-up and handling mechanism 237 shown in FIGS. 11–13 includes a pick-up rake 132, a conveyor 134, a washer 136, a stripper 138, and a crusher 140.

As best illustrated in FIG. 13, a number of nodule pick-up and handling mechanisms 237 are mounted at different locations on the miner vehicle 57. Thus, two mechanisms 237 are mounted in front of the miner vehicle 57 by means of a subframe comprising forwardly extending struts 239 and a crossbar 241. The two forward nodule pick-up mechanisms 237 are connected to trail the cross bar 241 (at substantially the same angle, about 60°, as the conveyor 134 of the FIG. 4 embodiment).

A third nodule pick-up mechanism 237 is located within the interior of the miner vehicle in trailing relation to the forward cross member 73 of the miner vehicle main frame.

Two other nodule pick-up mechanisms 237 are mounted in trailing relation from the rear cross member 73 of the miner vehicle main frame.

The way in which each pick-up mechanism 237 is mounted in trailing relation with respect to the main frame of the miner vehicle is best illustrated in FIG. 11. Each pick-up mechanism 237 comprises an outer housing 243, and all of the components of the nodule pick-up mechanism which pick up and handle the nodules are enclosed within and supported within the housing 243.

The housing 243 is mounted for controlled roll about pivotal connections 245 (see FIG. 11) to a frame assembly 247. The amount of roll is controlled by a cylinder 294 which is pivotally connected to the frame assembly 247 at one end and to the housing 243 at the other end.

The frame assembly 247 is in turn connected to the cross bar 241 by a pair of struts 249. The struts 249 are connected to the frame assembly 247 by lower pivotal connections 251. The upper end of each strut 249 is pivotally connected to the cross bar 241. The angular inclination of the struts 249 and the trailing attitude of the entire nodule pick-up mechanism 237 is therefore controlled by the cylinders 143 in substantially the same way that the corresponding cylinders 143 of the FIG. 6 embodiment control the trailing angle of the conveyor frame 135 and related pick-up rake 132.

The cylinders 143 provide a pressure balancing action for permitting the pick-up rake 132 to ride up and over nodules or other objects above a certain, selected size (as determined by the pressure within the cylinders 143) in much the same way as the controlled pressures within the cylinders 143 of the FIG. 4 embodiment provide a similar pressure balancing for the pick-up rake of that embodiment.

The frame assembly 247 is also pivotal about an axis extending through the lower pivot points 251. The control of this movement of the frame assembly 247 (and the housing 243) is provided by a cylinder 251 pivotally connected at its upper end to the frame member 241 and having the lower end of the piston rod pivotally connected at 253 to the frame assembly 247.

The pressure cylinder 252 in the FIG. 11 embodiment also provides a further degree of control over the angular inclination of the rake 132 with respect to the ocean bottom. It also allows the entire mechanism 237 to be tilted up for better viewing of the rake and washer by the TV camera.

The back side of the housing 243 includes a door 253 which is pivotally connected to the top of the housing 243 at 255.

A hydraulic cylinder 257 has one end pivotally connected at 259 to the frame assembly 247, and, the end of the piston rod is pivotally connected at 261 to the door 253.

In the closed position of the door 253, the lower end of the door 253 engages the enclosure 201 (see FIG. 12) to cause the crushed nodules to pass through the opening beneath the crusher to the conduit 230 in the direction of flow indicated by the arrows in FIG. 12. This flow is produced by a centrifugal pump 142 having an inlet manifold connected to the conduits 230 at the outlet of each crusher of each nodule pick-up 237. See FIG. 13.

With continued reference to FIG. 12, as the piston rod of the cylinder 257 is retracted, the door 253 is swung to the open position (indicated in the phantom outline in FIG. 12). Opening the door 253 in this way assists in clearing any jamming that might occur within the crusher 140.

The nodule pick-up mechanism 237 of the FIGS. 11–13 embodiment incorporates a rotary conveyor 134 rather than a conveyor belt and thus provides a more compact construction. The nodule pick-up and handling mechanism 237 of the FIGS. 11–13 embodiment does, however, incorporate the features of the FIGS. 2–10 embodiment which contribute significantly to high efficiency of nodule pick-up recovery. For example, the FIGS. 11–13 embodiment selects nodules within a certain size range as a result of the construction and arrangement of the tines 163 and 165. It cushions the inital pick-up of the nodules 171 by adjusting the inclination at which the tines engage the ocean bottom so that the rake picks up a limited amount of mud with the nodules while letting the major part of the mud flow through the tines of the rake. It provides means by which this entire assembly can be trailed at an angle, thus facilitating its ability to traverse uneven topography as well as the ability to ride over obstacles. It permits the speed of rotary movement of the fingers 185 to be closely matched to the speed of forward motion of the rake to produce a minimum of relative motion of the fingers 185 with respect to the nodules and mud being picked up. This minimizes initial impact on the nodules and thus minimizes fracturing of the nodules 171 on pick-up. It also minimizes the amount of mud which is stirred up into the water. The mechanism 237 quickly stabilizes the position of the picked-up nodules 171 on the conveyor 134, and the washer 136 therefore can hit the nodules hard with a washing jet to remove substantially all mud from the nodules at the washing station. The stripper 138 provides an active, positive stripping action to effectively remove even quite small nodule particles from the surface of the conveyor and from the fingers 185, and the angular inclination of the upper surface 233 of each stripper finger 213 is matched to the angular inclination of the leading edge 234 of each finger 185 so that the fingers 185 are always pushing and are never crushing the nodules at the stripping station.

A positive inflow of water is produced at all points leading to the interior of the mechanism 237 so that all nodule fines flow into, rather than out of, the crusher 140.

As shown in FIG. 12, a manifold 423 is also mounted within the housing of the crusher to push the nodule particles in the crusher to insure the positive inflow of particles into the crusher.

The pump 142 shown in FIG. 13 and in FIG. 36 is a centrifugal pump driven by a hydraulic or electric motor 263.

The outlet of the centrifugal pump 142 is connected to the hose 233 of the flexible linkage 61 for transferring the crushed nodule slurry to the buffer storage.

The construction and functioning of the buffer 59 in the underwater subsystem 55 will now be described with reference to FIGS. 1, 17–22, 26–33, and 35.

The buffer 59 provides two important functions in the mining system.

It provides a location for all the equipment not needed on the miner vehicle itself. This minimizes the bearing and propulsion requirements of the miner vehicle and permits a maximum mobility and maneuverability of the miner vehicle for increased mining efficiency.

The buffer 59 also provides a temporary storage for storing nodule slurry pumped to the buffer from the miner vehicle. This stored nodule slurry is then transferred from the buffer to a lift system which lifts the nodule slurry to the ship at a substantially uniform rate for increased lift efficiency and in a way that avoids possible stalling or jamming of the system.

Figure 19:
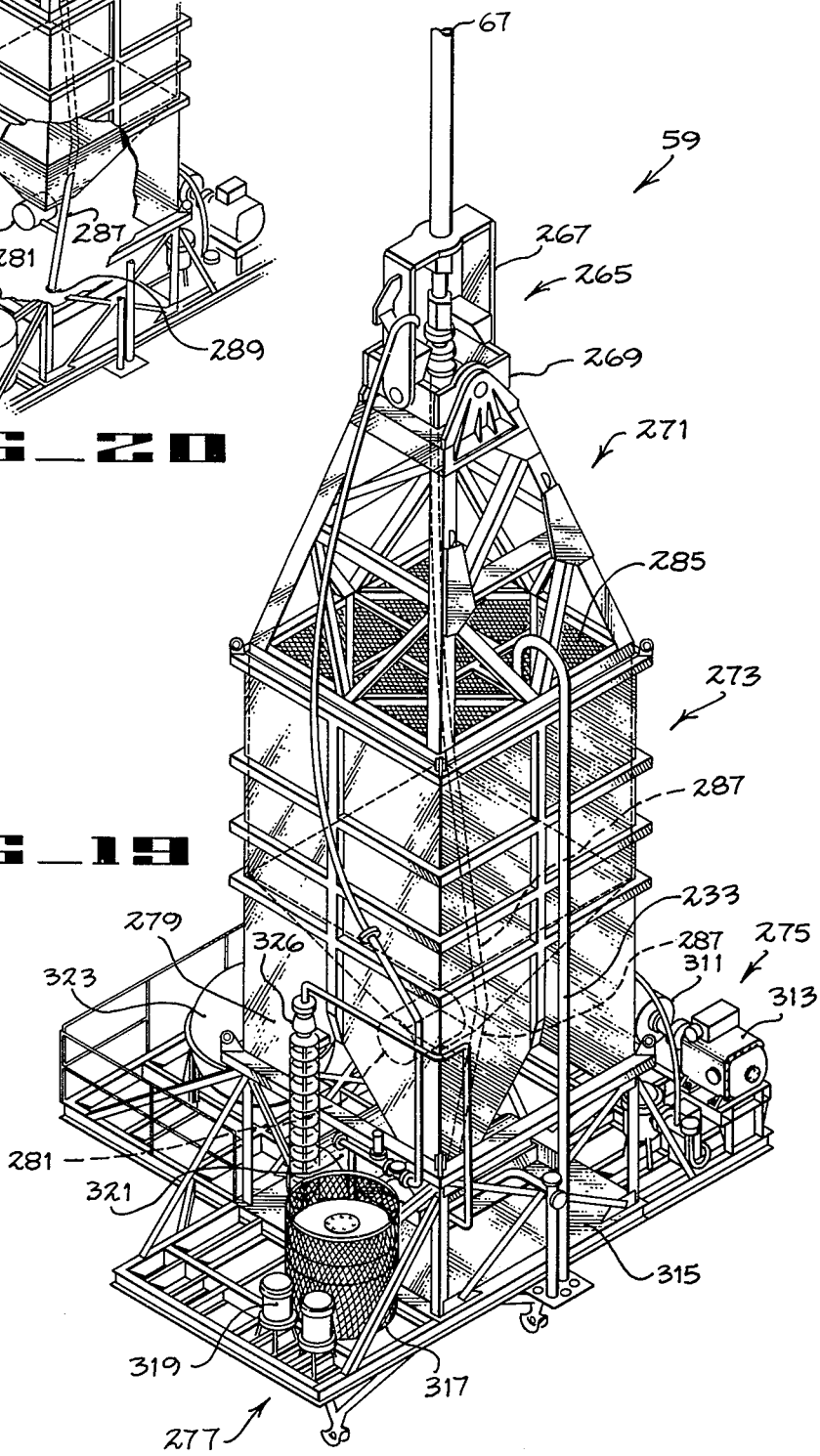
FIG. 19 is an isometric view of the buffer of the underwater subsystem of the miner system shown in FIG. 1.

As illustrated in FIG. 19, the buffer 59 is suspended from the pipe string 67 by an articulated connection 265 that permits a limited amount of tilting movement of the buffer with respect to the pipe string under the drag condition illustrated in FIG. 32 (and described in more detail below).

The articulated connection 265 comprises a split clevis block 267 and a gimbal ring 269.

The gimbal ring 269 is connected to a truss 271, and a buffer storage section 273 is connected to the truss 271.

An equipment section 275 is located below the storage section 273, and a transition section 277 is located below the equipment section of the buffer 59.

The storage section 273 of the buffer includes a conical feed section 279; and a variable speed, star vane feeder 281 (see FIGS. 19, 20 and 35) feeds the nodule slurry from the hopper formed by the conical feed section 279 to the lift system.

As illustrated in FIG. 35, the star vane feeder 281 is driven by a hydraulic motor 283.

In one embodiment of the lift system, an airlift 65 (as illustrated in FIGS. 1, 23–25 and 35, and described in greater detail below with reference to these FIGS.) is used as the lift system.

In another embodiment (as illustrated in FIGS. 22 and 36, and described in more detail below in reference to these Figs.) an electrically driven, staged, centrifugal pump is used as the lift system.

In a third embodiment, a dual pipe, pressurized sea water lift system is used. This lift system is a discontinuous system in which the nodule slurry is pumped up in batches from the buffer.

The airlift and electrically driven lift system provide a continuous lift of nodule slurry from the buffer to the ship without interruption.

As illustrated in FIG. 19, the conduit 233 transmits the nodule slurry from the flexible linkage 61 up to the top of the storage section 273, and a wire mesh 285 keeps the nodule slurry particles in the storage section 273 and lets sea water out.

The star vane feeder 281 feeds the nodule slurry from the hopper 279 to a conduit 287. The lower end of the conduit 287 has a flapper valve 289 (see FIG. 20) which is spring loaded to serve as a dump valve to dump excess pressure in the conduit 287 in the event of a blockage.

Figure 21A:
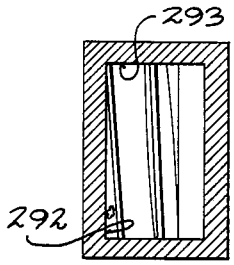
FIG. 21A is a cross section view taken along the line 21A—21A in FIG. 21.

The star vane feeder 281 incorporates spiraled, inner feeder vanes 291. See FIG. 21A. The spiraled configuration of vanes 291 minimizes any tendency of the vanes to become jammed at the edge 292 of the inlet 293 (see FIG. 21A). This is due to the fact that only a portion of the edge of a vane is presented at the edge 292 of the opening at any particular time. There is less opportunity for jamming than is the case when the entire edge of the vane is presented to the edge of the opening (and is susceptible to becoming jammed by the nodule slurry) as happens with a conventional straight edge star vane feeder.

The spiraled configuration of the vanes also produces a slicing action which helps to fracture any nodule particle that might become lodged between the vane and the edge 292.

The electrically driven lift system comprises one or more staged centrifugal pumps 295 having a inlet connected to the line 287 and having an outlet 297 connected to the pipe string 67. (See FIGS. 22 and 36.)

The staged centrifugal pumps 295 are driven by an electric motor 299. When two or more staged centrifugal pumps are used they may be valved into parallel or series operations.

In the airlift system the outlet 287 of the star feeder is also connected to the pipe string 67.

As illustrated in FIGS. 23–25, the airlift system 65 comprises an airline 301 which has a lower end connected to the pipe string 67 in a connector 303 (shown in detail in FIGS. 24 and 25).

The connector 303 is located about 5000 feet below the ship 63, and the airline 301 is periodically tied (by tie lines 305) to pipe sections of the lift pipe 67 as these pipe sections are added during the final lowering of the miner vehicle 57 to the ocean bottom.

As best illustrated in FIGS. 24 and 25A, the fitting 303 comprises a pipe string adapter section 307 which receives pressurized air from the airline 301. This section 307 is formed with three inwardly extending passage ways 309. This construction provides a strong, stabilized connection between the airline 301 and the lift pipe 67. It also permits relatively small diameter openings 309 to be formed in the section 307 since three small openings rather than one large opening are used to transmit the volume of air required to lift the nodule slurry. This provides a stronger connection at the lift pipe.

The air from the line 301 is distributed to the passage ways 309 by a clamp-on assembly best shown in FIGS. 25 and 25A. The clamp-on assembly includes air tubes 310. Each tube 310 has an inwardly extending tip 312 carried by a block 314, and the tip 312 fits in the outer end of a passage way 309. A seal 316 seals the connection of the tip 312 in the passage way 309. Screws 318 turn within a frame 320 to move the blocks 314 inwardly and to compress the seals 316. A locking handle 322 locks the screw 318 in place. One part 324 of the frame is disconnectable from the rest of the frame during installation and removal of the connector 303 to the pipe string.

The equipment section 275 of the buffer 59 (see FIG. 19 and FIG. 35) contains equipment used for operation of the miner vehicle 57.

This equipment includes a large horesepower electric motor 311 (a one thousand horsepower electric motor in a particular embodiment of the present invention), a hydraulic pump 313 driven by the electric motor 311, a salt water hydraulic pumping unit 315, an oil filled pressure compensator 317 (like the oil filled pressure compensating cylinders 111 described above with reference to the miner vehicle shown in FIG. 4), filters 319, a cylinder 321 containing a rack for the electrical controls, a pressure sphere 323 containing electronic components and a staged Peerless pump 326. FIG. 35 schematically shows these items of equipment carried by the equipment section of the buffer 59, and also shows the turbines 328 which can be driven from pressurized water pumped down the pipe string 67 (as a back up for the electrical motor drive by switching over the valve 425), a hydraulic valve box 250, a second electric motor 252 and hydraulic pump 254 (which is the back up salt water system), an EM disconnect box 334, a low voltage transformer 336, a high voltage transformer 338, electrical power and control and data cables 256, a data and command line 258, a 110 volt single phase line 346, a 440 volt three phase line 348 (all on the buffer), an electrical distributor box 350 and related data command control box 352 (on the miner vehicle), and (on the surface ship) a rotating slip ring 354, a 2000 volt three phase line 356, a transformer 358, a circuit breaker 360, the ship's power bus 362, a pipe handling, positioning and heave compensating system 429, a miner vehicle control center 364, an air compressor 366 and air control manifold 368 for the airlift system, sea water pumps 370 and an adapter 372 for the high pressure water back up drive for the turbines 328, an air separator 374, a sea water separator 376, and a nodule holding tank 378.

As best illustrated in FIG. 17, the flexible linkage 61 is connected to the transition section 277 of the buffer. This transition section includes a pair of downwardly extending braces 325 and a connector plate 327.

Two five-inch nylon lines 329 of the flexible linkage 61 are connected to eyelets at the lower ends of the braces 325, and the other lines, conduits and hoses of the flexible linkage 61 connect to the connector plate 327.

The flexible linkage 61 includes the flotation block 69 (described above for keeping the flexible linkage 61 up and out of the way of the miner vehicle 57 during mining operation) and three spreader bars 331. The spreader bars 331 maintain the various lines, conduits and hoses of the flexible linkage 61 properly spaced and untangled during operation.

As illustrated in FIG. 18, the flexible linkage 61 includes the nylon ropes 329, the conduit 233 for transferring nodule slurry from the miner vehicle to the buffer, a conduit 193 for conducting high pressure water to the miner vehicle, an electrical umbilical conduit 333, and four hydraulic conduits 335, 337, 339 and 341. Two of the hydraulic lines are high pressure lines and two of the hydraulic lines are return lines.

The electrical conduit 333 contains an outer sheath which encloses a number of control cables and power cables. The interior of this sheath is pressurized by the oil filled compensators 111 of the miner vehicle and 317 of the buffer to prevent the individual lines and cables within the sheath from being compressed together by the pressure of the ambient sea water acting on the exterior of the sheath to a point where the insulation on the cable might be frayed or broken.

A number of tie lines 330 are also used in the flexible linkage as shown in FIG. 17; and a number of local syntactic foam rings 332 are also used beneath the lower spreader bar 331 to help keep individual conduits afloat and away from the miner vehicle.

The way in which the miner vehicle 57, buffer 59, flexible linkage 61, and flotation block 69 are deployed from the ship 63 (at the air-water interface between the surface subsystem and the underwater subsystem at the start of a mining operation) is an important, and sometimes critical part of the whole operation and will now be described with reference to FIGS. 26-30.

Figure 26:
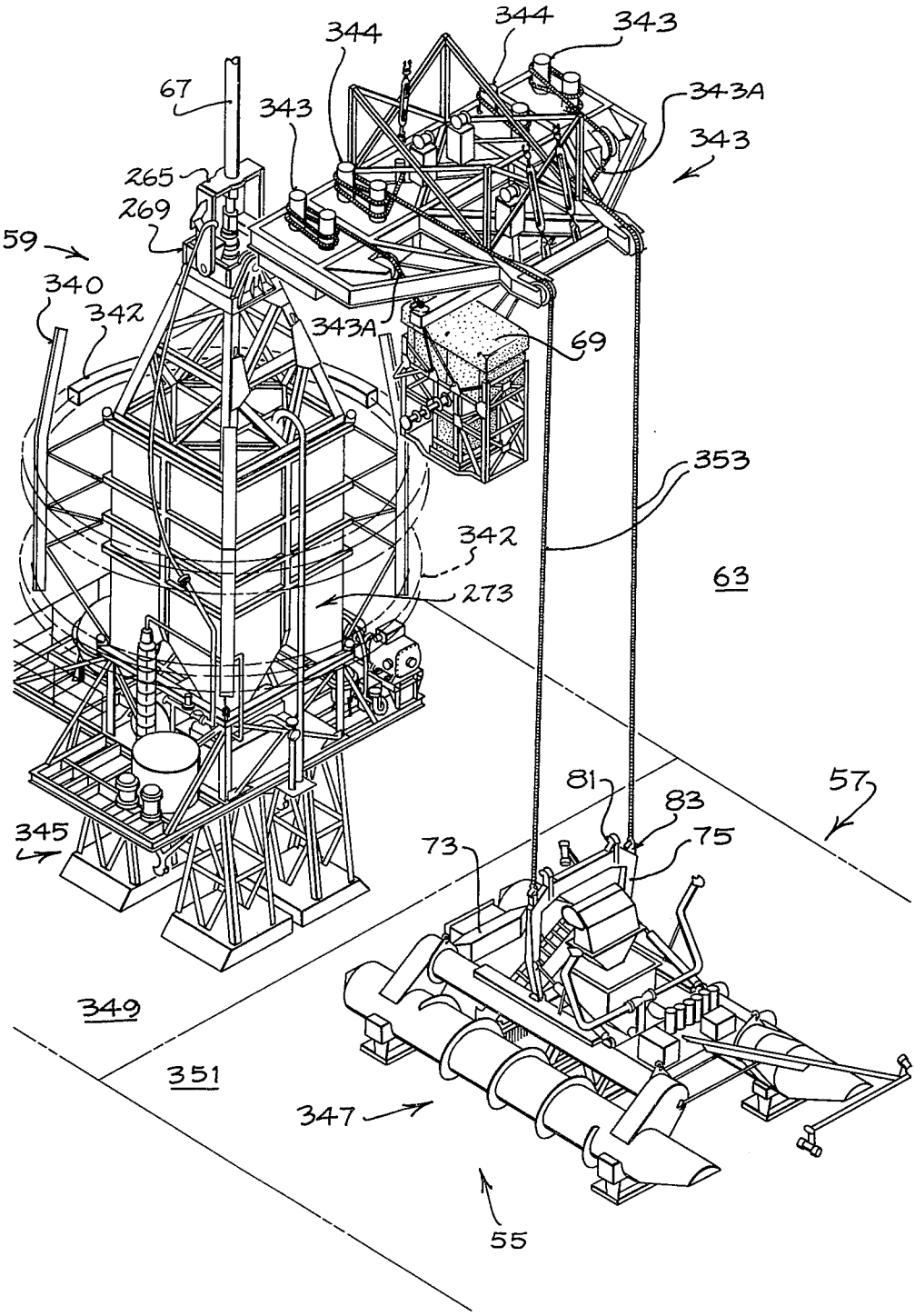
FIG. 26 is an isometric view showing how the components of the underwater subsystem of the miner system are positioned within the ship in preparation for deployment by a traction winch. The sequence of operations involving the deployment by means of the traction winch is illustrated in FIGS. 27 through 29.

FIG. 26 shows the components of the underwater system 55 as they are deployed within the well or moonpool of the ship 63 ready for deployment.

As illustrated in FIG. 26, the buffer 59 has vertically extending fenders 340 which fit within docking rings 342 fixed within the hold of the ship for guiding the buffer 59 out of the hold and back into the hold at the start of deployment and at the end of a mining operation. These fenders 340 have been omitted from most of the views showing the buffer 59 for simplicity of illustration.

Two traction winches 343 and 344 are used for deployment of the flotation block 69 and the miner vehicle 57.

At the start, the buffer 59 rests on supports 345, and the miner vehicle 57 rests on supports 347 on sliding doors 349 and 351. The flotation block 69 is suspended from the traction winch 343 by cables 343A until the well or moonpool 63 is flooded to the level shown in FIG. 27.

At this point the cables 343A are disconnected from the flotation block 69, and the flotation block 69 is permitted to float on the water.

Cables 353 of the traction winch 344 are connected to the eyelets 83 of the lift frame 75.

The traction winch 344 lifts the miner vehicle 57 far enough to remove the supports 347, and the derrick 355 (see FIG. 23) lifts the buffer 59 far enough to remove the supports 345. The sliding doors 349 and 351 are then opened, and the miner vehicle 57 and buffer 59 are lowered through the opening as illustrated in FIGS. 28 and 29.

As the flexible linkage 61 become fully extended to the point where it carries the entire weight of the miner vehicle 57 directly from the buffer 59, the cables 353 are disconnected from the traction winch 344 and tied off to the flotation block 69 and to the buffer 59 as shown in FIG. 29.

FIG. 23 shows how pipe sections are added to the pipe string 67 on the ship as the miner vehicle is lowered to the ocean bottom.

FIG. 23 also shows how the airline of the airlift system is associated with the pipe string, and FIG. 23 also illustrates how the electrical control and power lines are associated with the added pipe sections.

With continued reference to FIG. 23, the ship 63 contains propellers 357 which provide forward and aft thrust, and propellers 359 provide side thrust to enable the ship 63 to follow the miner vehicle 57.

FIG. 23 also shows the three control consoles 361, 363 and 365 (of the miner vehicle control center 364) which are used to control all operations of the miner vehicle.

In a particular embodiment the mining console 361 is used for mining control. This console controls the positioning of the pick-up and the feeding of the nodules pumped into the conduit to the lift pipe by the star vane feeder.

The console 363 is a vehicle control console. The operator of this console controls the speed and direction of the miner vehicle and provides instruction to the ship to change the speed or to change direction to coordinate the movement of the ship with the movement of the miner vehicle. The envelope of possible miner operation (shown in FIG. 34) is displayed on the screen 367 of this console 363.

The console 365 is an obstacle avoidance console, and the operator of this console monitors the sensors which provide early warning and assessment of the surrounding terrain to be mined by the miner vehicle. The operator of this console watches the display provided by side-scanning sonar, TV cameras and location and bearing sonars to bring to the attention of the operator of the vehicle-control console information on problems that might be presented by later passes of the miner vehicle through the particular area being mined.

Each operator at each console can select any of the TV cameras for viewing on the screens of a particular console, but each operator in practice relies primarily on certain TV cameras for information on his areas of responsibility.

Figures 30, 31, 32:
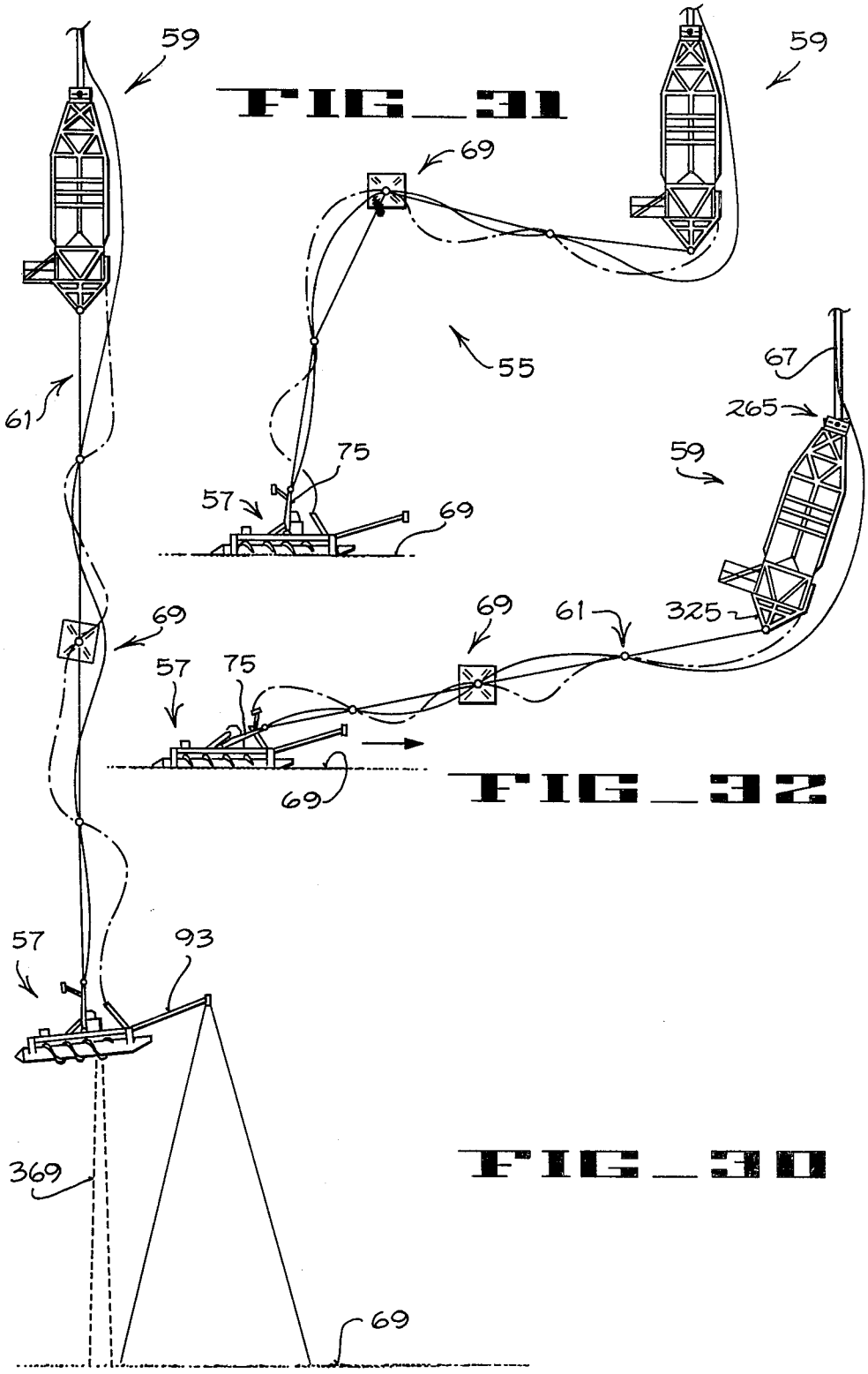
FIG. 30 is a side elevation view of the underwater subsystem with the miner vehicle approaching the ocean bottom.
FIG. 31 is a side elevation view showing the components of the underwater subsystem with the components in the normal operating mode. In this normal operating mode, the flexible linkage between the buffer and the miner vehicle is maintained suspended up and above the miner vehicle while the miner vehicle operates within an area enclosed within a generally kidney-shaped envelope pattern (shown in FIG. 34) beneath the buffer. In this normal operating mode, the movement of the ship is controlled as required to follow the movement of the miner vehicle on the ocean bottom.
FIG. 32 is a side elevation view like FIGS. 30 and 31 but showing the miner vehicle in a drag mode condition. This drag mode condition is a temporary condition which occurs only when the movement of the ship overruns the movement of the miner vehicle. Dragging of the miner vehicle is permitted by an articulated connection beneath the pipe string and the buffer and a pivotal connection between the miner vehicle and a lift frame which connects the miner vehicle to the flexible linkage.

The last step in the deployment is illustrated in FIG. 30 where the miner vehicle has approached to within about 100 feet of the ocean bottom 69.

At this point an altitude sonar on the miner vehicle 57 (by means of the beam 369 shown in dash outline FIG. 30) measures the vertical distance to the ocean floor, and this measured distance is transmitted to the control consoles 361, 363 and 365 on the ship 63. The lights and TV cameras at the end of the instrument boom 93 also provide a picture of the surface of the ocean bottom beneath the miner vehicle. The ship 63 can be maneuvered, as required, to let the miner vehicle 57 touch down at a suitable place on the ocean floor as shown by the TV picture.

FIG. 31 shows the disposition of the component parts of the underwater subsystem 55 in the normal operating position of these component parts. In this condition of normal operation, the miner vehicle 57 can operate beneath the buffer 59 within an envelope of operation 371 (see FIG. 34) which is in a general kidney shape. The overall area included within this kidney-shaped envelope is dependent upon the height of the buffer 59 above the ocean floor. The height of the buffer 59 from the ocean floor 69 is determined by an altitude sonar signal 371 (see FIG. 33). The location of the miner vehicle 57 with the boundary envelope is determined by a range and bearing sonar system (indicated by the arrow 373 in FIG. 33).

Figures 33, 34:
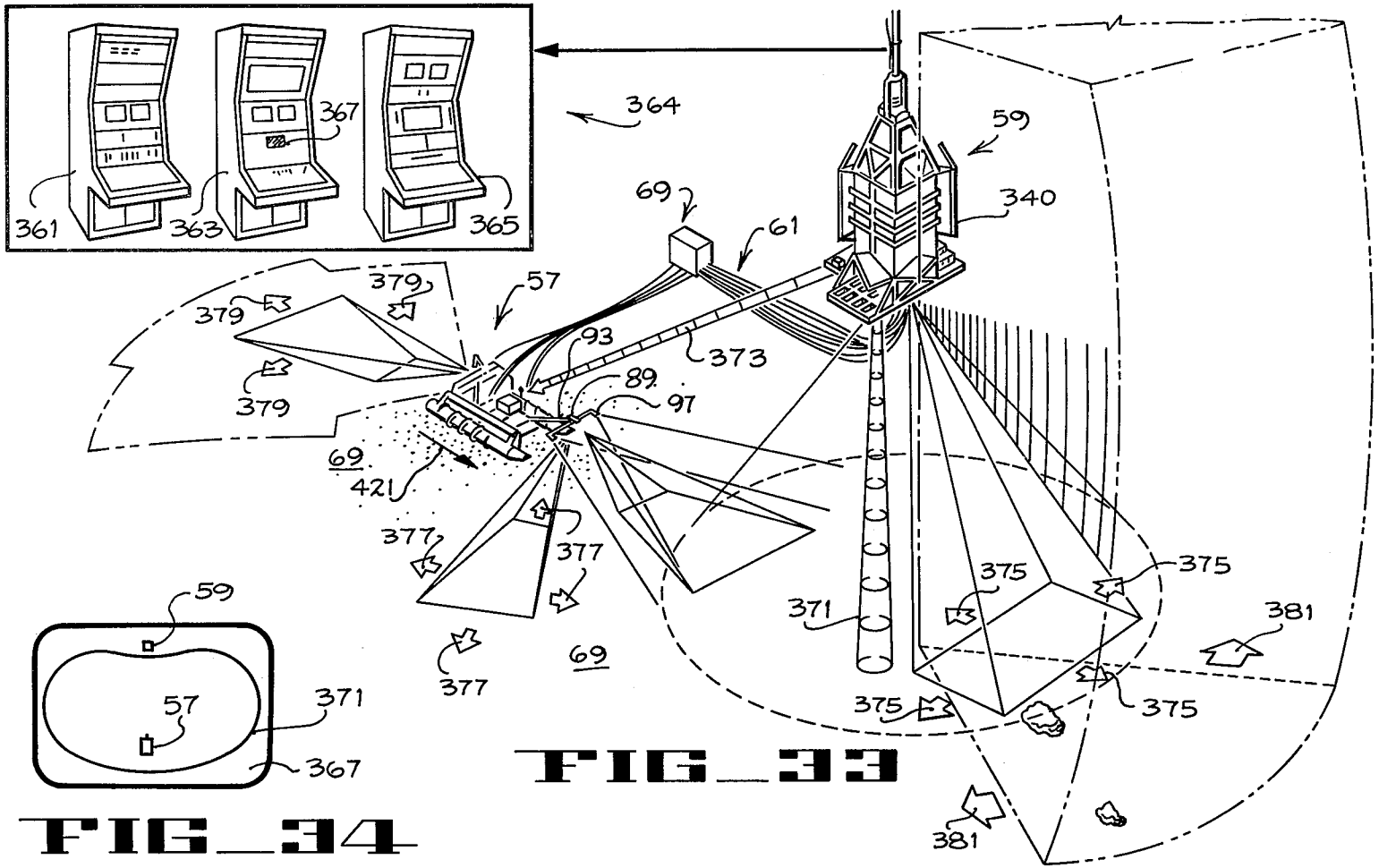
FIG. 33 is an isometric view showing the methods and apparatus for controlling the miner vehicle on the ocean bottom.
FIG. 34 is an enlarged view of the generally kidney-shaped envelope displayed on one of the three ship located control consoles. This generally kidney-shaped envelope is displayed as a function of the range and bearing sonar systems illustrated in FIG. 33 and indicates the limits of operation permitted by the flexible linkage between the buffer and the miner vehicle at a particular height of the buffer above the ocean bottom.

FIG. 34 illustrates how the position of the miner vehicle 57 within the boundary envelope 371 is displayed on the screen 367 in response to the latitude, range and bearing signals produced by the control components on the buffer 59 and the miner vehicle 57 as illustrated in FIG. 33. As the miner vehicle moves forward (in the direction indicated by the arrow 421 in FIG. 33) toward the bottom edge of the envelope 371 as viewed in FIG. 34, the ship moves forward to move the buffer 59 at the same rate to keep the miner vehicle 57 within the envelope of operation permitted by the linkage 61.

FIG. 32 shows the miner vehicle 57 in a drag mode condition. This drag mode condition is a temporary condition which occurs only when the movement of the ship 63 overruns the movement of the miner vehicle 57. The miner vehicle 57 is then dragged, like an anchor, and the dragging of the miner vehicle is permitted by the articulated connection 265 between the pipe string 67 and the buffer 59 and by the pivotal connection between the miner vehicle 57 and the lift frame 75. These connections permit the cylinder 79 to drop the lift frame 75 over to the drag angle illustrated in FIG. 32. Once the temporary overrun of the ship with respect to the miner vehicle has been corrected, the under water subsystem 55 is returned to the disposition of components shown in FIG. 31 and mining of the nodules is resumed.

FIG. 33 also shows graphically the range of visual and other sensing systems that are used to supply information to the control operators with respect to the operation of the miner vehicle and the environment. The altitude and range and bearing sonar signals are used to keep the related dimensions within certain limits so that the miner vehicle can operate in the desired envelope. These signals permit the shipboard operators to give instructions to the ship to slow down the ship or to speed up the ship or to change the direction of the ship as required to enable the miner vehicle to stay with the desired envelope. This envelope is computed automatically from information derived from the height of the buffer from the ocean floor and the geometry of the flexible linkage between the buffer and the miner vehicle. A TV screen located on the console of the vehicle operator illustrates the envelope in reference to the buffer and the miner vehicle in reference to the buffer. By this means the operator can maintain the miner vehicle within the safe operating range.

A TV camera mounted on the buffer 59 can swing, by means of a pan-and-tilt mounting arrangement, in any of the directions indicated by the arrows 375.

TV cameras on the forwardly-extending control boom 93 are moveable to scan different areas as indicated by the arrows 377.

A TV camera on the aft part of the vehicle miner 57 is moveable to scan different areas as indicated by the arrows 379.

Side-scanning sonar on the buffer 59 is moveable to scan different areas as indicated by the arrows 381.

FIG. 34 illustrates how the position of the miner vehicle 57 with the boundary envelope 371 is displayed on the screen 367 in response to the latitude, range and bearing signals produced by the control components on the buffer 59 and the miner vehicle 57 as illustrated in FIG. 33.

The effect of all these sensing systems, in combination, is to present a highly developed picture of the topography, possible obstacles, and all aspects of current operation of the mining operations occurring within the miner vehicle itself which are needed to accomplish efficient pick-up and handling of nodules by remote control of the operators on the ship.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A method of mining manganese nodules from the ocean floor and lifting the nodules to a surface ship and comprising, extending a relatively rigid pipe string downwardly from the surface ship until the lower end of the pipe string is positioned a relatively short distance above the ocean floor, placing a self-propelled, maneuverable, miner vehicle having a nodule pick-up mechanism on the ocean floor, connecting the miner vehicle to the lower end of the pipe string by a flexible linkage comprising power, data and control lines for the miner vehicle and which is long enough and flexible both longitudinally and laterally to permit the vehicle to operate longitudinally and laterally beneath the end of the pipe string within an area having a substantial lateral extent and within a boundary envelope determined by the flexible linkage, sensing the location of the miner vehicle within the permitted area of operation.

viewing the topography of the ocean floor adjacent the vehicle, indicating the location of the miner vehicle within the permitted area of operation and displaying the topgraphy of the ocean floor on indicator means located in the ship, self-propelling and maneuvering the miner vehicle on the ocean floor, actively controlling the speed and direction of the miner vehicle from a control center within the ship in response to the information indicated by the indicator means, and coordinating the movement of the ship with the movement of the vehicle to cause the ship and pipe string to follow the motion of the miner vehicle and to move the area of permitted operating along with and in the direction of movement of the miner vehicle as required to retain the miner vehicle in said boundary envelope.

2. The invention defined in claim 1 including viewing the topography by both side scanning sonar and TV cameras.

3. The invention defined in claim 1 wherein the miner vehicle includes a crusher mechanism for crushing the nodules into a nodule slurry and including viewing the operation of the nodule pick-up mechanism and the nodule crusher mechanism by TV cameras, displaying the operation of these mechanisms on the indicator means located in the ship, and controlling the operation of these mechanisms from the ship in response to the information indicated on the indicator means.

4. The invention defined in claim 3 wherein the connection to the lower end of the pipe string includes a buffer having a storage section and including pumping the nodule slurry from the vehicle to the buffer storage section for temporary storage.

5. The invention defined in claim 4 including feeding the nodule slurry from the buffer storage at a controlled rate to a lift system which lifts the nodule slurry to the surface ship.

6. The invention defined in claim 5 including lifting the nodule slurry by an airlift.

7. The invention defined in claim 5 including lifting the nodule slurry by an electrically driven, staged, centrifugal pump mounted on the buffer.

8. The invention defined in claim 4 including distributing the weight between the miner vehicle and the buffer so as to maximize the mobility and maneuverability of the miner vehicle by locating on the buffer the equipment which does not need to be located on the miner vehicle.

9. The invention defined in claim 4 including suspending the flexible linkage above the miner vehicle.

10. An ocean mining system of the kind which picks up manganese nodules from the ocean floor and lifts the nodules to a surface ship, said system comprising, ocean bottom subsystem means including a self propelled, maneuverable, miner vehicle for picking up nodules from the ocean floor, ocean surface subsystem means including a ship for receiving the nodule material picked up by the miner vehicle, lift means for lifting the nodule material from the bottom subsystem to the ship and including a relatively rigid pipe string extending downwardly from the ship and having a lower end positioned a relatively short distance above the ocean floor, said bottom subsystem means including flexible linkage means comprising power, data and control lines for the miner vehicle and extending between the miner vehicle and a connection to the lower end of the pipe string, said linkage means being flexible both laterally and longitudinally and being long enough to permit the vehicle to operate longitudinally and laterally beneath the end of the pipe string within an area having a substantial lateral extent and within a boundary envelope determined by the flexible linkage, said bottom subsystem including sensor means for sensing the location of the miner vehicle within the permitted area of operation and for viewing the topography of the ocean floor adjacent the vehicle, indicator means located in the ship and operatively associated with the sensor means for indicating the location of the miner vehicle within the permitted area of operation and for displaying the topography viewed by the sensor means, said miner vehicle including drive means and manuevering means for self-propelling and maneuvering the miner vehicle on the ocean floor, and control means located in the ship for actively controlling the speed and direction of movement of the miner vehicle in response to the information indicated by the indicator means and for coordinating the movement of the ship with the movement of the vehicle to cause the ship and pipe string to follow the motion of the miner vehicle and to move the area of permitted operation along with and in the direction of the movement of the miner vehicle as required to retain the miner vehicle in the boundary envelope.

11. The invention defined in claim 10 wherein the sensor means include side scanning sonar and TV cameras for viewing the topography.

12. The invention defined in claim 10 wherein the vehicle includes additional sensor means comprising a compass, a level, and attitude measuring sonar and wherein the indicator means are operatively associated with the sensor means for indicating these features of operation of the miner vehicle.

13. The invention defined in claim 10 wherein the miner vehicle includes nodule pick-up and handling means for picking up nodules from the ocean floor and crusher means for crushing the picked up nodules to a nodule slurry, the sensor means include TV cameras for viewing the operation of the nodule pick-up and handling means and the crusher means, the indicator means include TV screens for indicating the operation of the nodule pick-up and handling means and the crusher means, and the control means are effective to control the operation of the nodule pick-up and handling means and the crusher means from the ship.

14. The invention defined in claim 13 wherein the connection to the lower end of the pipe string includes a buffer having a storage section for storing the nodule slurry and including means for transferring the nodule slurry from the crusher means to the storage section of the buffer.

15. The invention defined in claim 14 including feeder means on the buffer for feeding the nodule slurry from the storage section to the lift means at a controlled rate.

16. The invention defined in claim 14 wherein the buffer includes an equipment section and wherein equipment not needed on the miner vehicle is located on the equipment section of the buffer to distribute the weight between the vehicle and the buffer so as to maximize the mobility and maneuverability of the vehicle.

17. The invention defined in claim 10 including suspension means operatively associated with the flexible linkage for maintaining the flexible linkage suspended above the miner vehicle during operation.

18. The invention defined in claim 10 wherein the lift means include an airlift.

19. The invention defined in claim 10 wherein the lift means include an electrically driven, staged, centrifugal pump forming a part of the ocean bottom subsystem means and located at the connection to the lower end of the pipe string.

20. An ocean bottom system for mining manganese nodules from the ocean floor and comprising, a self-propelled, maneuverable miner vehicle constructed for operation on the ocean floor and having pick-up means for picking up nodules from the ocean floor, buffer means constructed for suspension above the ocean floor by a connection to the pipe string extending downwardly from a surface ship and having a storage section for temporary storage of the nodule material mined by the vehicle, and flexible linkage means inter-connecting the buffer means and the vehicle, said flexible linkage means being flexible both longitudinally and laterally and being long enough to permit the miner vehicle to operate beneath the buffer means within an area having a substantial lateral extent and within a boundary envelope determined by the flexible linkage means, and said flexible linkage means comprising an electrical umbilical conduit effective to conduct all power transmission and all control functions to the vehicle and data transfer to and from the vehicle through the flexible linkage means and a nodule material hose for transferring nodule material from the vehicle to the buffer storage section through the flexible linkage means.

21. The invention defined in claim 20 wherein the buffer means have an equipment section and wherein the equipment not needed on the miner vehicle is located in the equipment section of the buffer to minimize the weight of the miner vehicle and to maximize the mobility and maneuverability of the miner vehicle on the ocean floor.

22. The invention defined in claim 21 wherein the equipment section includes an electronic pressure vessel and a hydraulic control rack.

23. The invention defined in claim 22 wherein the equipment section includes pressure compensating means for maintaining the pressure within electrical control lines balanced with respect to the ambient ocean pressure.

24. The invention defined in claim 20 including nodule crusher means mounted on the miner vehicle for crushing the nodules to a slurry and pump means for pumping the crushed slurry from the vehicle to the buffer through the nodule material hose of the flexible linkage means.

25. The invention defined in claim 24 wherein the buffer means include feeder means for feeding the nodule slurry at a controlled rate from the buffer storage section to a lift system which lifts the slurry through the pipe string to the surface ship.

26. The invention defined in claim 20 wherein the buffer means include a transition section located below the storage section and wherein the flexible linkage means are connected to the transition section.

27. The invention defined in claim 20 wherein the buffer means include articulated connected means for connecting the buffer means to the pipe string, the miner vehicle includes a lift frame pivotally connected to the miner vehicle, and the articulated connection, pivotal lift frame and flexible linkage permit the miner vehicle to be towed by the pipe string if the ship temporarily overruns the miner vehicle.

28. The invention defined in claim 20 wherein the miner vehicle includes propulsion means for propelling the miner vehicle along the ocean floor at a controlled rate and in a controlled direction of movement.

29. The invention defined in claim 28 wherein the propulsion means include archimedes screws with each screw having a flotation drum which provides support on the ocean bottom and positive buoyancy in the ocean environment and flights on the drum which provide traction in the soli on the ocean floor.

30. The invention defined in claim 20 wherein the pick-up means include a rake having laterally spaced and forwardly and downwardly angled tines.

31. The invention defined in claim 30 including positioning means for controlling the depth of penetration of the tines within the soil of the ocean floor.

32. The invention defined in claim 20 wherein the flexible linkage means include tension means for carrying all tension forces transmitted through the flexible linkage such as the tension forces produced during deployment and pick-up of the miner vehicle to and from the ocean floor.

33. The invention defined in claim 20 wherein flexible linkage means include spreader bars effective to maintain all lines and hoses of the flexible linkage laterally spaced apart during operation of the miner vehicle.

34. The invention defined in claim 20 wherein the flexible linkage means include suspension means effective to maintain the flexible linkage suspended above the miner vehicle during operation.

35. The invention defined in claim 34 including flotation rings on individual lines of the flexible linkage for maintaining localized flotation of those individual lines.

36. A buffer for an ocean mining system of the kind in which the manganese nodules are picked up from the ocean floor by a self-propelled, maneuverable, miner vehicle and are then transferred to a temporary storage in the buffer and are later lifted to a surface ship through a pipe string, said buffer comprising, a storage section for temporary storage of nodule material, connecting means for suspending the buffer above the ocean floor from the lower end of a pipe string extending downwardly from a surface ship, feeder means for feeding the nodule material from the storage section to a lift system which lifts the nodule material to a surface ship, and an equipment section comprising power units and electrical controls for powering and contolling the operation of the miner vehicle.

37. The invention defined in claim 36 wherein the connection means include a clevis block and a gimbal ring effective to permit the buffer to be tilted at a limited angle with respect to the pipe string.

38. The invention defined in claim 36 wherein the feeder means include a star vane feeder located at the bottom of the storage section and drive means for driving the star vane feeder to feed the nodule slurry from the buffer storage to a lift system at a controlled rate.

39. The invention defined in claim 38 wherein the star vane feeder includes vanes that have a spiral configuration for minimizing jamming of nodule slurry fed from the buffer storage to the inlet of the star vane feeder.

40. The invention defined in claim 38 wherein the feeder means include pressure relief valve means for dumping the nodule slurry in the event of an excessive build up of pressure between the outlet of the star vane feeder and the inlet of the lift system.

41. The invention defined in claim 36 including pump means operatively associated with the feeder means for pumping the nodule slurry to the surface ship through the pipe string.

42. The invention defined in claim 36 wherein the buffer includes a truss section between the storage section and the connecting means.

43. The invention defined in claim 36 wherein the buffer includes a transition section beneath the equipment section and constructed for connection to a flexible linkage associated with the miner vehicle.

44. A flexible linkage for an ocean mining system of the kind in which manganese nodules are picked up from the ocean floor by a self-propelled, maneuverable, miner vehicle and are then transferred to temporary storage in a buffer and are later lifted to a surface ship through a pipe string, said flexible linkage being constructed to interconnect the vehicle and the buffer and comprising, power lines effective to conduct all power transmission to the vehicle through the flexible linkage, control lines effective to conduct all control functions to the vehicle through the flexible linkage, a nodule material hose for transferring nodule material from the vehicle to the buffer storage through the flexible linkage, and suspension means operatively associated with the power lines, control lines, and nodule material hose for maintaining the lines and the hose suspended above the miner vehicle during operation of the vehicle on the ocean floor.

45. The invention defined in claim 44 wherein the flexible linkage includes spreader bar means for maintaining all of the lines and hoses of the flexible linkage laterally spaced apart during operation.

46. A miner vehicle for an ocean mining system of a kind in which manganese nodules are picked up from the ocean floor and lifted to a surface ship, said vehicle comprising, a main frame, crusher means mounted on the main frame for crushing the pick-up nodules to produce a nodule slurry, a nodule pick-up and handling mechanism mounted on the main frame, said nodule pick-up and handling mechanism including a pick-up rake having laterally spaced apart tines for picking up the nodules, conveyor means for conveying the nodules from the pick-up rake to the crusher means, washing means for washing the nodules on the conveyor to remove soil picked up by the rake mechanism prior to crushing the nodules, stripper means for removing the nodules from the conveyor at the inlet to the crusher means, and propulsion means and maneuvering means for propelling and maneuvering the vehicle on the ocean floor.

47. The invention defined in claim 46 including rake positioning means for controlling the depth of penetration of the pick-up rake tines into the soil of the ocean floor.

48. The invention defined in claim 47 wherein the tines are inclined at a forward and downward angle to pick up a controlled amount of the soil with the nodules while letting the rest of the soil pass through the rake tines.

49. The invention defined in claim 47 wherein the positioning means include a hydraulic cylinder and control means operated at the surface ship for varying the pressure in the hydraulic cylinder to permit the rake to ride up and over obstacles above a certain size.

50. The invention defined in claim 47 wherein every sixth tine is longer than the other tines.

51. The invention defined in claim 47 including multiple pick-up and handling mechanisms mounted on the main frame.

52. The invention defined in claim 47 including an articulated connection between the main frame and the nodule pick-up and handling mechanism.

53. The invention defined in claim 52 wherein the nodule pick-up and handling mechanism is mounted at a trailing angle with respect to the direction of forward movement of the vehicle.

54. The invention defined in claim 47 wherein the propulsion means include archimedes screws with each screw having a drum section which provides bearing support on the ocean floor and positive buoyancy in the ocean environment and a spiraled flight for engaging the ocean floor to provide traction.

55. The invention defined in claim 54 wherein the propulsion means comprise two archimedes screws and wherein each screw has a drive motor at each end of the screw.

56. The invention defined in claim 55 including drive motor control means for controlling the drive of each motor independently of the other motors for the screws.

57. The invention defined in claim 55 wherein the screws are laterally spaced apart far enough to provide good side hill stability for mining on a contour.

58. The invention defined in claim 55 wherein the flights on the two screws are oppositely spiraled so that the screws counter rotate to provide stabilized forward motion without a tendency to veer to one side.

59. The invention defined in claim 54 wherein the drum sections of the screws are filled with syntactic foam.

60. The invention defined in claim 47 wherein the conveyor means include a conveyor belt.

61. The invention defined in claim 47 wherein the conveyor means include a conveyor drum.

62. The invention defined in claim 47 wherein the conveyor means include nodule engaging finger means for picking up the nodules from the rake and for holding the nodules in a stabilized position on the surface of the conveyor.

63. The invention defined in claim 62 wherein the conveyor means includes a conveyor surface for carrying the nodules and the finger means include a plurality of fingers which project outwardly from the surface to engage the backside of the nodules carried on the conveyor surface.

64. The invention defined in claim 63 including drive means for moving the fingers within the rake at a speed just slightly greater than the speed of the forward movement of the rake to minimize the impact of the fingers on the nodules within the rake.

65. The invention defined in claim 47 wherein the washing means include a manifold and nozzles mounted closely adjacent the outlet of the pick-up and effective to direct jets of water under relatively high pressure against the nodules to insure effective cleaning of the nodules prior to crushing.

66. The invention defined in claim 65 including screen means operatively associated with the conveyor means and with the washing means for retaining small nodule particles in the path of transport of the nodules from the washing means to the crushing means.

67. The invention defined in claim 47 including suction means operatively associated with the crusher means for producing a constant inflow of water through the crusher means to minimize loss of nodule fines.

68. The invention defined in claim 47 including pump means for pumping the crushed nodule slurry from the crusher means to temporary storage in a buffer.

69. The invention defined in claim 47 wherein the stripper means include a plurality of bars for engaging the underside of the nodules to positively lift the nodules from the conveyor at the inlet to the crusher means.

70. The invention defined in claim 69 wherein the conveyor means include a conveyor surface and the stripper means include flexible strips for engaging the surface of the conveyor means to sweep small nodule particles off of the surface at the inlet to the crusher means.

71. The invention defined in claim 70 wherein the conveyor means include upright fingers for engaging the backside of the nodules and wherein the bars of the stripper means have an inclined outer surface shaped to avoid pinching of the nodules between the conveyor fingers and the stripper bars.

72. The invention defined in claim 47 including a lift frame pivotally connected to the main frame.

73. The invention defined in claim 72 including an umbilical cable associated with the lift frame and movable with the lift frame as the lift frame is swung about the pivotal connection to the main frame.

74. The invention defined in claim 72 including motor means for changing the angle of the lift frame with respect to the main frame and lift frame angle control means for actuating the motor means by remote control from the surface ship.

75. The invention defined in claim 72 including pressure compensating means for balancing the internal pressures of the umbilical cable against the ambient ocean pressure.

76. The invention defined in claim 47 including flexible linkage means for operatively connecting the miner vehicle to feed the nodule slurry to a lift system associated with the pipe string while isolating the miner vehicle from mechanical restraint by the piper string.

77. The invention defined in claim 47 including sensor means on the miner vehicle for sensing the location of the miner vehicle and for viewing the topography of the ocean floor adjacent the miner vehicle.

78. The invention defined in claim 77 wherein the sensor means include a compass, a level, lights, sonar for measuring the attitude of the miner vehicle with reference to the ocean floor, TV cameras and pulse sonar equipment for indicating the distance and bearing of the miner vehicle with respect to the lower end of the pipe string.

79. A nodule pick-up and handling mechanism for mining manganese nodules from the ocean floor and comprising, rake means for picking up the nodules from the ocean floor, said rake means having laterally spaced tines inclined at an angle to position the lower ends of the tines forwardly of the upper ends of the tines in the direction of pick-up movement of the mechanism, positioning means for varying the depth of penetration of the tines in the soil in the ocean floor, conveyor means for conveying the picked-up nodules away from the rake means, nodule washing means for washing the nodules on the conveyor, said washing means including a plurality of nozzles located to direct pressurized jets of water against the nodules on the conveyor means to remove the soil picked up by the rake means, and wherein the conveyor means include an outer surface on which the nodules are supported and have outwardly projecting fingers effective to stabilize the nodules in position on the conveyor before and during washing so that relatively high washing pressures can be used in the nozzles to accomplish efficient removal of soil from the nodules without dislodging the nodules from the conveyor.

80. The invention defined in claim 79 including rake positioning means for positioning the angle and the penetration of the tines in the ocean floor to control the amount of soil picked up with the nodules and the amount of the soil permitted to pass through the rake.

81. The invention defined in claim 80 wherein the rake positioning means include a frame, a pivotal connection of the rake means to the frame, a variable length hydraulic motor for moving the rake with respect to the frame about the pivotal connection and control means for regulating the pressure within the hydraulic motor to permit the rake to ride up and over objects above a certain size.

82. The invention defined in claim 79 wherein the tines have a fixed lateral spacing effective to control the minimum size nodule picked up.

83. The invention defined in claim 79 including drive means for the conveyor and drive control means for adjusting the peripheral speed of the fingers to substantially the same speed as the forward speed of the rake tines so that the speed of the fingers with respect to the nodules is relatively slow.

84. The invention defined in claim 79 including crusher means for crushing the nodules to a nodule slurry after the soil has been removed from the nodules by the nodule washing means.

85. The invention defined in claim 84 including stripper means for stripping the nodules from the conveyor means at the inlet to the crusher means.

86. The invention defined in claim 84 including suction means for creating a positive inflow of water at the inlet to the crusher means to prevent loss of nodule particles.

87. The invention defined in claim 84 including pump means for pumping the crushed nodule slurry from the crusher means to a buffer storage.

88. The invention defined in claim 84 wherein the crusher means include a hinged side wall and motor means for moving the side wall to an open position to help clear jamming in the crusher means.

89. The invention defined in claim 79 including a main frame on which the nodule pick-up and handling mechanism is mounted and propulsion means for transporting the main frame and nodule pick-up and handling mechanism along the ocean floor.

90. A method of mining manganese nodules from the ocean floor and comprising, picking up the nodules from the ocean floor by a rake mechanism having laterally spaced tines, conveying the pick-up nodules away from the rake mechanism by a moving conveyor, washing the nodules on the conveyor by pressurized jets of water to remove the soil picked up by the rake mechanism, and stabilizing the nodules in position on the conveyor before and during washing so that relatively high pressures can be used to accomplish efficient removal of soil without dislodging the nodules from the conveyor.

91. The invention defined in claim 90 including cushioning the initial impact of the tines on the nodules by positioning the rake at an angle which picks up a controlled amount of ocean bottom soil with the nodule to minimize loss of nodule material by possible breakage resulting from the initial impact.

92. The invention defined in claim 90 including transporting the rake along the ocean floor by means of a self-propelled vehicle.

93. The invention defined in claim 92 including trailing the rake at an angle with respect to the vehicle and connecting the rake for pivoting movement with respect to the vehicle so that the rake can ride up and over obstacles of a given size or larger.

94. The invention defined in claim 90 including crushing the nodules to a slurry in a crusher mechanism after the ocean bottom soil has been washed off the nodules.

95. The invention defined in claim 90 including stripping the nodules from the moving conveyor at the inlet to the crusher.

96. The invention defined in claim 95 including producing an inflow of water into the inlet of the crusher as the nodules are stripped from the conveyor to retain all fines and small module materials for maximizing efficiency of pick-up and crushing.

97. The invention defined in claim 94 including pumping the slurry to a temporary storage in a buffer.

98. The invention defined in claim 97 including storing the slurry in the temporary storage in the buffer.

99. The invention defined in claim 98 including feeding the slurry at a controlled rate from the buffer storage to a lift system which lifts the slurry to a surface ship.

* * * * *